US012390900B2

(12) United States Patent
Hatakeyama

(10) Patent No.: US 12,390,900 B2
(45) Date of Patent: Aug. 19, 2025

(54) WORK MACHINE

(71) Applicant: KOKI HOLDINGS CO., LTD., Tokyo (JP)

(72) Inventor: Kentaro Hatakeyama, Ibaraki (JP)

(73) Assignee: KOKI HOLDINGS CO., LTD., Tokyo (JP)

( * ) Notice: Subject to any disclaimer, the term of this patent is extended or adjusted under 35 U.S.C. 154(b) by 235 days.

(21) Appl. No.: 17/794,881

(22) PCT Filed: Dec. 25, 2020

(86) PCT No.: PCT/JP2020/048840
§ 371 (c)(1),
(2) Date: Jul. 22, 2022

(87) PCT Pub. No.: WO2021/149459
PCT Pub. Date: Jul. 29, 2021

(65) Prior Publication Data

US 2023/0055261 A1 Feb. 23, 2023

(30) Foreign Application Priority Data

Jan. 24, 2020 (JP) ..... 2020-010369

(51) Int. Cl.
*B24B 41/04* (2006.01)
*B24B 23/02* (2006.01)
*B24B 47/12* (2006.01)

(52) U.S. Cl.
CPC ..... *B24B 41/04* (2013.01); *B24B 23/028* (2013.01); *B24B 47/12* (2013.01)

(58) Field of Classification Search
CPC ... B24B 55/052; B24B 55/102; B24B 55/105; B24B 47/12; B24B 23/00; B24B 23/02;
(Continued)

(56) References Cited

U.S. PATENT DOCUMENTS 2,473,513 A * 6/1949 Dewey ..... F16C 33/80 384/480
2011/0203826 A1 8/2011 Hosokawa et al.

FOREIGN PATENT DOCUMENTS

CN 2871098 Y 2/2007
CN 201763831 U 3/2011
(Continued)

OTHER PUBLICATIONS

WO2019171721—Machine Translation (Year: 2019).*
(Continued)

*Primary Examiner* — Brian D Keller
*Assistant Examiner* — Alberto Saenz
(74) *Attorney, Agent, or Firm* — NovoTechIP International PLLC

(57) ABSTRACT

The work machine includes: a gear housing; a spindle protruding in a first direction from the gear housing; a bearing held by the gear housing and including an inner race and an outer race, the bearing rotatably supporting the spindle; a tip tool attachment portion to which a tip tool is attachable, the tip tool attachment portion being provided at the spindle; a sealing member positioned further in the first direction than the bearing; and a restricting member for restricting the sealing member from moving in the first direction. At least a part of the sealing member is overlapped with the inner race in an axial direction of the spindle. The restricting member is held either by the spindle or by the gear housing.

14 Claims, 12 Drawing Sheets

(58) Field of Classification Search
CPC ... B24B 23/005; B24B 23/022; B24B 23/024; B24B 23/026; B24B 23/028; B24B 23/03; B24B 23/04; B24B 23/046; B24B 27/00; B24B 27/08; B24B 41/04; B24B 41/047; B24B 45/006; B25F 5/001; B25F 5/02
USPC ..... 451/294, 344, 350, 351, 352, 353, 357, 451/358, 359
See application file for complete search history.

(56) References Cited

FOREIGN PATENT DOCUMENTS

| | | | |
|---|---|---|---|
| CN | 205231905 | U | 5/2016 |
| JP | 2011167812 | A | 9/2011 |
| JP | 2015213989 | A | 12/2015 |
| JP | 2019209455 | A | 12/2019 |
| WO | WO-2019171721 | A1 * | 9/2019 |

OTHER PUBLICATIONS

International Preliminary Report on Patentability issued Jul. 26, 2022 by the International Searching Authority in PCT Application PCT/JP2020/048840 (English Translation).
International Search Report and Written Opinion issued Jan. 19, 2021 by the International Searching Authority (Japan Patent Office) in PCT Application PCT/JP2020/044490 (Partial English Translation).
Chinese Office Action issued on Mar. 13, 2025 in connection with Chinese application No. 202080094302.3 (with machine translation).

* cited by examiner

WORK MACHINE

TECHNICAL FIELD

The present invention relates to a work machine.

BACKGROUND ART

There have conventionally been widely used work machines that perform machining work such as grinding or cutting. Patent literature 1 discloses, as an example of the work machines, an electric grinder including a motor, a bevel gear configured to rotate by rotation of the motor, a spindle extending downward from the bevel gear and configured to rotate together with the bevel gear, a tip tool attachment portion provided at the lower portion of the spindle, and a gear cover rotatably supporting the bevel gear and the spindle.

In the above-described electric grinder, the motor is driven in a state where the tip tool such as a grinding stone is attached to the tip tool attachment portion, so that the bevel gear, the spindle, the tip tool attachment portion, and the tip tool are integrally rotated to perform machining work such as grinding by the rotating tip tool. The spindle of the electric grinder is rotatably supported by two bearings; one bearing is positioned at the inner upper portion of the gear cover and the other bearing is positioned at the inner lower portion of the gear cover. The lower portion of the spindle protrudes downward from the lower portion of the gear cover.

CITATION LIST

Patent Literature

PTL1: Japanese Patent Application Publication No. 2011-167812

SUMMARY OF INVENTION

Technical Problem

In the above-described electric grinder, machining work such as grinding is performed by the tip tool attached to the tip tool attachment portion provided at the lower portion of the spindle. Accordingly, the work portion subject to machining work such as grinding is performed is close to the lower portion of the gear case. Hence, powder dust generated by the machining work such as grinding may enter the bearing provided at the lower portion of the gear case. Further, entry of such powder dust into the bearing may hinder the spindle from smoothly rotating, which may degrade workability.

In view of the foregoing, it is an object of the present invention to provide a work machine that can favorably maintain workability by suppressing powder dust generated by machining work from entering the bearing rotatably supporting the spindle.

Solution to Problem

In order to attain the above and other objects, the present invention provides a work machine including: a gear housing; a spindle protruding in a first direction from the gear housing; a bearing held by the gear housing and including an inner race and an outer race, the bearing rotatably supporting the spindle; a tip tool attachment portion to which a tip tool is attachable, the tip tool attachment portion being provided at the spindle; a sealing member positioned further in the first direction than the bearing; and a restricting member for restricting the sealing member from moving in the first direction. At least a part of the sealing member is overlapped with the inner race in a radial direction of the spindle. The restricting member is held either by the spindle or by the gear housing.

With the above configuration, the restricting member held either by the spindle or by the gear housing restricts the sealing member from moving in the first direction at a position where the sealing member is overlapped with the inner race of the bearing in the radial direction, thereby attaining favorable sealability. As a result, entry of powder dust generated in machining work into the bearing can be suitably suppressed, and accordingly, workability can be favorably maintained.

In the above configuration, it is preferable that the gear housing includes a bearing holding portion molded integrally with the bearing.

In the above configuration, it is preferable that the bearing holding portion includes: a cylindrical supporting member extending in the first direction and supporting an outer circumferential surface of the outer race; and a protruding portion positioned further in the first direction than the outer race, the protruding portion protruding inward in the radial direction of the spindle from the cylindrical supporting member to restrict the bearing from moving in the first direction.

In the above configuration, it is preferable: that an inward end of the protruding portion in the radial direction is positioned further inward in the radial direction than the outer circumferential surface of the outer race and further outward in the radial direction than an inner circumferential surface of the outer race; and that the sealing member is provided between the protruding portion and the spindle in the radial direction.

According to another aspect, the present invention provides a work machine including: a gear housing; a spindle protruding in a first direction from the gear housing; a bearing held by the gear housing and including an inner race and an outer race, the bearing rotatably supporting the spindle; a tip tool attachment portion to which a tip tool is attachable, the tip tool attachment portion being provided at the spindle; a sealing member positioned further in the first direction than the bearing; and a restricting member for restricting the sealing member from moving in the first direction. The gear housing includes a bearing holding portion molded integrally with the bearing and holding the bearing. The bearing holding portion includes: a cylindrical supporting member extending in the first direction and supporting an outer circumferential surface of the outer race; and a protruding portion positioned further in the first direction than the outer race, the protruding portion protruding inward in a radial direction of the spindle from the cylindrical supporting member to restrict the bearing from moving in the first direction. An inward end of the protruding portion in the radial direction is positioned further inward in the radial direction than the outer circumferential surface of the outer race and further outward in the radial direction than an inner circumferential surface of the outer race. The sealing member is provided between the protruding portion and the spindle. At least a part of the sealing member is overlapped with the inner race in the axial direction. The restricting member is held either by the spindle or by the bearing holding portion.

Typically, effect of reduction in production cost of the work machine is obtained when the bearing holding portion molded integrally with the bearing is employed. However, in such a configuration, the inward end in the radial direction of the protruding portion restricting the bearing from moving in the first direction (i.e., the position at which movement in the first direction of the bearing is restricted) needs to be positioned further outward in the radial direction than the inner circumferential surface of the outer race because of the molding process used for the bearing holding portion. Further, although the sealing member exhibits proper sealability at a position overlapping with the inner race in the axial direction, it is difficult to fix the position of the sealing member at the above-described suitable position in a configuration where the inward end in the radial direction of the protruding portion needs to be positioned further outward in the radial direction than the inner circumferential surface of the outer race. However, with the above configuration according to the present invention, the sealing member is restricted from moving in the first direction at the overlapping position in the axial direction with the inner race of the bearing by virtue of the restricting member held either by the spindle or by the bearing holding portion. Hence, the position of the sealing member can be fixed at the overlapping position in the axial direction with the inner race of the bearing despite the configuration where the bearing holding portion molded integrally with the bearing is employed, and therefore, reduction in production cost and suitable sealability can be realized. As a result, entry of powder dust generated in machining work into the bearing can be suitably suppressed, and accordingly, workability can be favorably maintained.

In the above configuration, it is preferable that the restricting member is positioned between the spindle and the protruding portion in the radial direction.

With this configuration, the restricting member is positioned in the space between the spindle and the protruding portion which space needs to be sealed. Hence, the restricting member also functions as a dust proof member. Accordingly, entry of powder dust generated in machining work into the bearing can be further suitably suppressed, and workability can be further favorably maintained.

In the above configuration, it is preferable that the restricting member is fixed to an outer circumferential surface of the spindle and rotates together with the spindle.

In the above configuration, it is preferable: that the restricting member includes: an annular portion fixed to the spindle; a cylindrical portion extending in the first direction from an outer circumferential edge in the radial direction of the annular portion; and a flange portion extending outward in the radial direction from an outer circumferential surface of an end portion in the first direction of the cylindrical portion; and that the restricting member is positioned outward of the cylindrical portion in the radial direction.

In the above configuration, it is preferable that the restricting member is fixed to the bearing holding portion.

With this configuration, because the restricting member does not rotate, friction is unlikely to be generated between the restricting member and the sealing member whose position is fixed by the restricting member. Accordingly, early wearing of the sealing member can be suppressed.

In the above configuration, it is preferable: that the restricting member includes: an annular portion positioned outward of the spindle in the radial direction; a cylindrical portion extending in a second direction from an outer circumferential edge in the radial direction of the annular portion, the second direction being opposite to the first direction; and a flange portion fixed to the bearing holding portion, the flange portion extending outward in the radial direction from an outer circumferential surface of an end portion in the second direction of the cylindrical portion; and that the sealing member is positioned between the spindle and the cylindrical portion.

With this configuration, the dimension in the radial direction of the sealing member overlapped with the inner race in the axial direction can be reduced. Hence, friction can be further suppressed from being generated between the restricting member and the sealing member, thereby further suppressing early wearing of the sealing member.

In the above configuration, it is preferable that the restricting member is fixed to the bearing holding portion by press-fitting.

In the above configuration, it is preferable that the restricting member is fixed to the bearing holding portion by molding the bearing holding portion integrally with the restricting member.

Advantageous Effects of Invention

The present invention can provide a work machine that can favorably maintain workability by suppressing powder dust generated by machining work from entering the bearing rotatably supporting the spindle.

BRIEF DESCRIPTION OF DRAWINGS

FIGS. 6A-6F are views for describing a process of integral molding of the bearing holding portion with the first bearing in the disc grinder according to the first embodiment of the present invention, in which: FIG. 6A illustrates a state where the first bearing has been fixed to a mold member used for molding the lower end part of the bearing holding portion; FIG. 6B illustrates a state where another mold member used for molding the center portion in the up-down direction of the bearing holding portion has been assembled to the mold member used for molding the lower end part of the bearing holding portion; FIG. 6C illustrates a state where a mold used for molding the bearing holding portion has been completed; FIG. 6D illustrates a state where a liquid resin has been poured in the internal space of the completed mold; FIG. 6E illustrates a state where the resin has been solidified and a mold member used for molding the upper part of the bearing holding portion has been removed; and FIG. 6F illustrates a state where the bearing holding portion having the first bearing held thereon has been molded.

FIGS. 12A-12F are views for describing a process of integral molding of the bearing holding portion with both the first bearing and a restricting member in the disc grinder according to the third embodiment of the present invention, in which FIG. 12A illustrates a state where the restricting member and the first bearing have been fixed to a mold member used for molding the lower end part of the bearing holding portion; FIG. 12B illustrates a state where another mold member used for molding the center portion in the up-down direction of the bearing holding portion has been assembled to the mold member used for molding the lower end part of the bearing holding portion; FIG. 12C illustrates a state where a mold used for molding the bearing holding portion has been completed; FIG. 12D illustrates a state where a liquid resin has been poured in the internal space of the completed mold; FIG. 12E illustrates a state where the resin has been solidified and a mold member used for molding the upper part of the bearing holding portion has been removed; and FIG. 12F illustrates a state where the bearing holding portion holding on which both the first bearing and the restricting member have been held has been molded.

DESCRIPTION OF EMBODIMENTS

1. Description of First Embodiment

Figure 1:
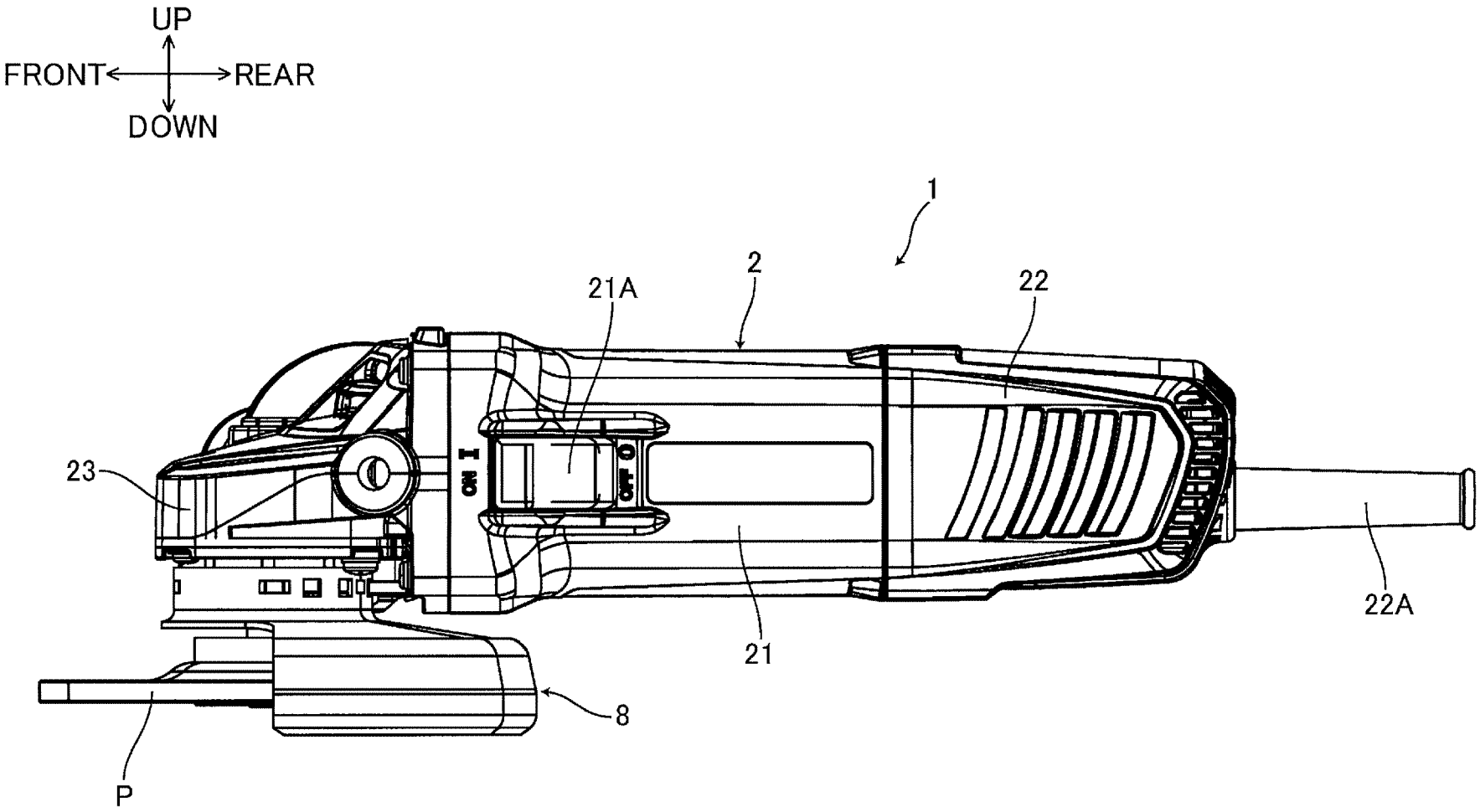
FIG. 1 is a side view illustrating the external appearance of a disc grinder according to a first embodiment of the present invention.

Hereinafter, a disc grinder 1 as an example of a work machine according to a first embodiment of the present invention will be described with reference to FIGS. 1 through 6. The disc grinder 1 is an electric work machine used for performing grinding work and cutting work on a workpiece using a tip tool P formed in a disc like shape, such as a grinding stone.

In the following description, "front", "rear", "up", and "down" indicated in the drawings will be defined as the frontward direction, rearward direction, upward direction, and downward direction, respectively. Further, "right" and "left" when viewing the disc grinder 1 from the rear thereof will be defined as the rightward direction and leftward direction, respectively.

1-1. Outline of Overall Structure of Disc Grinder 1 According to First Embodiment As illustrated in FIGS. 1 through 3, the disc grinder 1 includes a housing 2, a motor 3, a power transmission portion 4, an output shaft supporting portion 5, an output shaft portion 6 to which the tip tool P such as a grinding stone is attachable, a dust proof portion 7, and a wheel guard 8.

Figure 2:
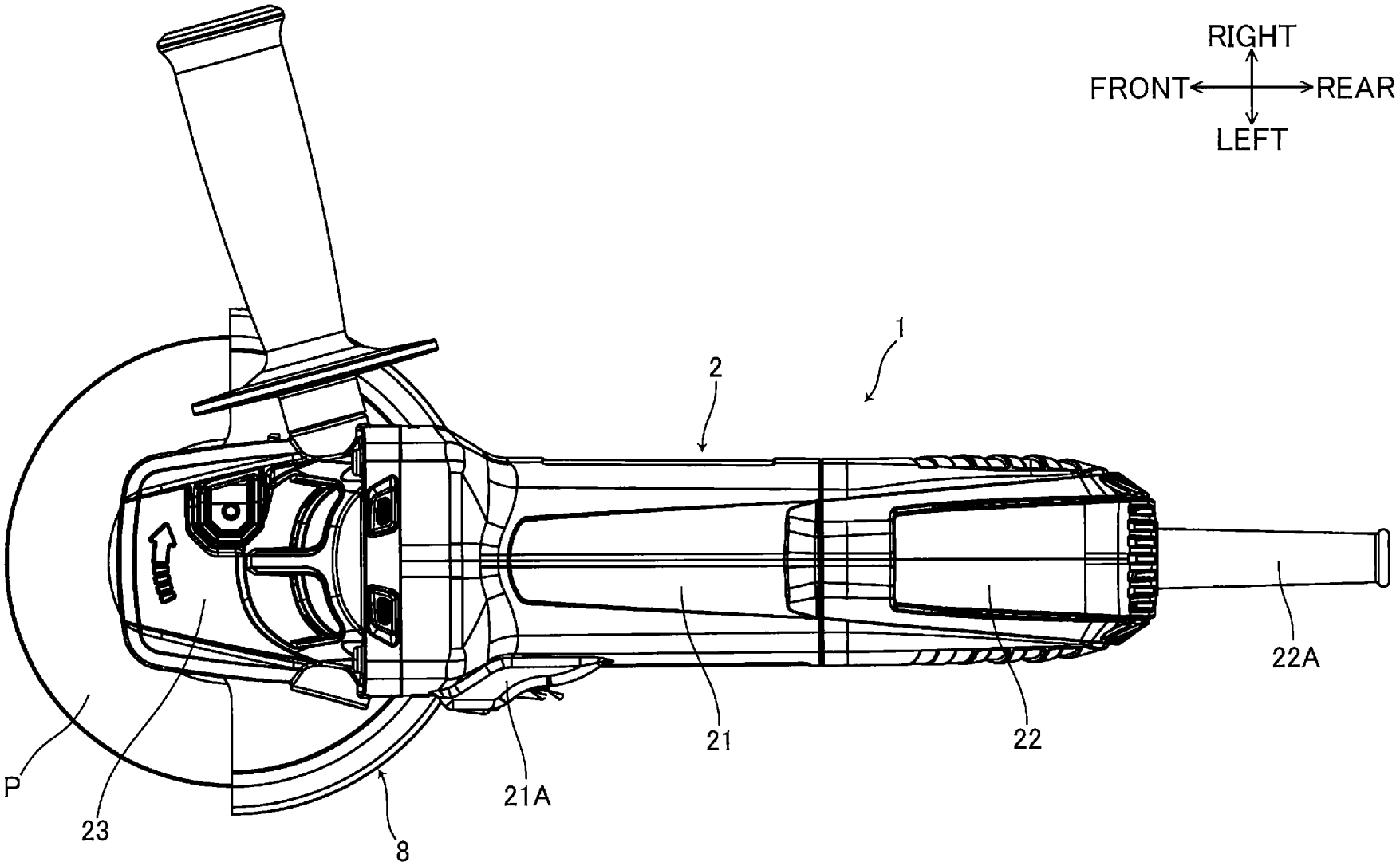
FIG. 2 is a plan view illustrating the external appearance of the disc grinder according to the first embodiment of the present invention.
Figure 3:
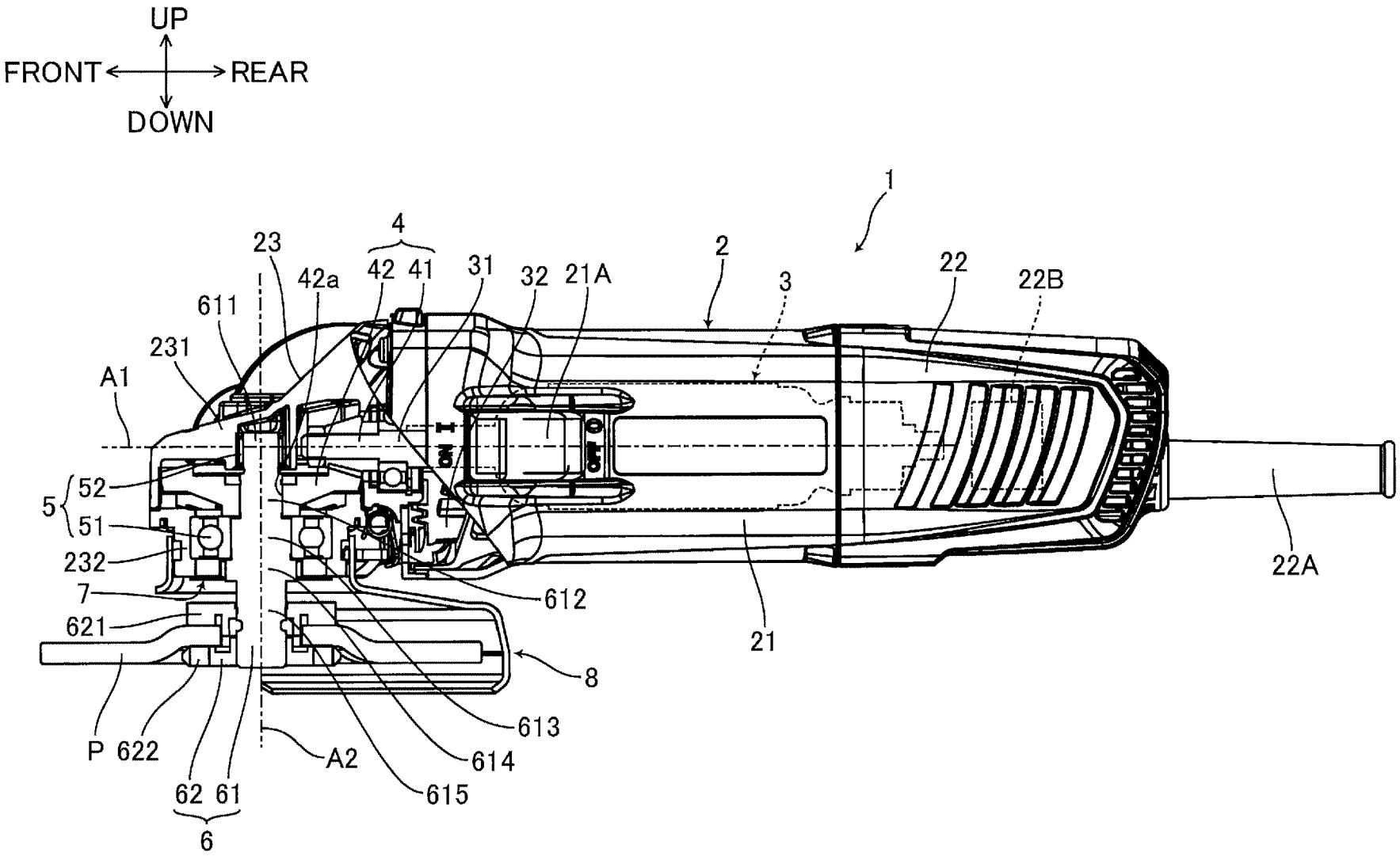
FIG. 3 is a partial vertical cross-sectional view illustrating the internal structure of the disc grinder according to the first embodiment of the present invention.

As illustrated in FIGS. 1 and 2, the housing 2 constitutes the outer shell of the disc grinder 1. The housing 2 includes a motor housing 21, a tail housing 22, and a gear housing 23.

The motor housing 21 is made of resin or metal and has a tubular shape extending in the front-rear direction. The motor housing 21 accommodates therein the motor 3. The front portion of the left side surface of the motor housing 21 is provided with a slidable drive switch 21A. The drive switch 21A is manually operable for controlling start and stop of the motor 3.

The tail housing 22 is made of resin or metal and has a generally polygonal tubular shape extending rearward from the rear end portion of the motor housing 21. A power supply cord portion 22A extends rearward from the rear end portion of the tail housing 22. The power supply cord portion 22A can be connected to an AC power supply (not illustrated), such as a commercial AC power supply. As illustrated in FIG. 3, the tail housing 22 accommodates therein a switch mechanism 22B.

The switch mechanism 22B is a switch configured to be switched between an ON state and an OFF state in response to an operation to the drive switch 21A. The switch mechanism 22B electrically connects the motor 3 to the power supply cord 22A in the ON state, and shuts off electrical connection between the motor 3 and the power supply cord portion 22A in the OFF state. The switch mechanism 22B is brought into the ON state in response to an ON operation (a frontward slide operation) to the drive switch 21A, and is brought into the OFF state in response to an OFF operation (a rearward slide operation) to the drive switch 21A. When the ON operation to the drive switch 21A is performed in a state where the power supply cord portion 22A is connected to an AC power supply, the switch mechanism 22B enters the ON state to cause electric power to be supplied from the AC power supply to the motor 3 through the switch mechanism 22B and the power supply cord portion 22A, so that the motor 3 is driven.

As illustrated in FIG. 3, the gear housing 23 protrudes frontward from the front end portion of the motor housing 21. The gear housing 23 includes a gear cover 231 and a bearing holding portion 232. The gear housing 23 accommodates therein the power transmission portion 4, the output shaft supporting portion 5, and the upper portion of the output shaft portion 6.

The gear cover 231 constitutes the upper portion of the gear housing 23 and is made of metal such as aluminum. The bearing holding portion 232 constitutes the lower portion of the gear housing 23 and is fixed to the lower portion of the gear cover 231 by a bolt, etc. Details of the bearing holding portion 232 will be described later.

The motor 3 is an AC motor with brush and includes a rotation shaft 31, a rotor (not illustrated), and a stator (not illustrated). As illustrated in FIG. 3, the rotation shaft 31 extends in the front-rear direction and is rotatably supported by the motor housing 21. The rotation shaft 31 is rotatable about a first rotation axis A1 extending in the front-rear direction. A fan 32 for generating cooling air inside the housing 2 is fixed to the front portion of the rotation shaft 31. The fan 32 is rotatable coaxially and together with the rotation shaft 31.

The rotor is fixed to the rotation shaft 31 so as to be rotatable coaxially and together with the rotation shaft 31.

The rotor includes a plurality of rotor coils. The stator includes a plurality of driving coils and a plurality of braking coils.

The power transmission portion 4 is a mechanism configured to transmit rotation of the motor 3 to the output shaft portion 6. The power transmission portion 4 is accommodated in the gear cover 231 of the gear housing 23. As illustrated in FIG. 3, the power transmission portion 4 includes a pinion gear 41 and a bevel gear 42.

The pinion gear 41 extends in the front-rear direction and is fixed to the front end portion of the rotation shaft 31. The pinion gear 41 is rotatable coaxially and together with the rotation shaft 31. When the motor 3 is driven, the pinion gear 41 rotates about the first rotation axis A1 together with the rotation shaft 31.

The bevel gear 42 has an approximate disc shape and is in meshing engagement with the pinion gear 41. A through-hole 42*a* is formed at the center portion in a plan view of the bevel gear 42. The through-hole 42*a* penetrates the bevel gear 42 in the up-down direction.

The output shaft supporting portion 5 rotatably supports the output shaft portion 6 such that the output shaft portion 6 is rotatable about a second rotation axis A2. As illustrated in FIG. 3, the output shaft supporting portion 5 includes a first bearing 51 and a second bearing 52. The first bearing 51 is a ball bearing held by the bearing holding portion 232. The first bearing 51 includes an outer race 51A and an inner race 51B, which have each an annular shape in a plan view. The first bearing 51 rotatably supports the output shaft portion 6 at the center portion in the up-down direction of the output shaft portion 6. The second bearing 52 is a needle bearing and is provided in the inner upper portion of the gear cover 231. The second bearing 52 rotatably supports the output shaft portion 6 at the upper end portion of the output shaft portion 6. Details of the first bearing 51 will be described later.

The output shaft portion 6 performs machining work such as grinding by rotating in a state where the tip tool P is attached to the output shaft portion 6. As illustrated in FIG. 3, the output shaft portion 6 includes a spindle 61 and a tip tool attachment portion 62.

The spindle 61 is a shaft extending in the up-down direction and having a generally solid cylindrical shape. The upper end portion of the spindle 61 is accommodated in the gear housing 23, while the lower end portion of the spindle 61 protrudes downward from the gear housing 23. The spindle 61 is supported by the first bearing 51 and the second bearing 52 so as to be rotatable about the second rotation axis A2. The upper portion of the spindle 61 is press-fitted through the through-hole 42*a* of the bevel gear 42. Hence, the output shaft portion 6 and the bevel gear 42 are fixed to each other. When the pinion gear 41 rotates, the spindle 61 and the bevel gear 42 rotate together about the second rotation axis A2 extending in a direction approximately orthogonal to the first rotation axis A1 (in the present embodiment, the second rotation axis A2 extends in the up-down direction). Details of the spindle 61 will be described later. The downward direction is an example of the "first direction" in the present invention. The upward direction is an example of the "second direction" in the present invention. The lower end portion of the spindle 61 is an example of the "first end portion" in the present invention. The upper end portion of the spindle 61 is an example of the "second end portion" in the present invention.

The tip tool attachment portion 62 is a portion to which the tip tool P is attached. The tip tool attachment portion 62 includes a washer 621 and a nut 622. The washer 621 is a member for holding the tip tool P in cooperation with the nut 622. The washer 621 has a generally annular shape in a plan view and is fixed to the lower portion of the spindle 61. The nut 622 has a generally annular shape in a plan view and is threadingly engageable with a male thread portion formed on the lower end portion of the spindle 61.

For example, a grinding stone, a bevel wire brush, a non-woven fabric brush, a diamond wheel, and the like are available as the tip tool P. Examples of the grinding stone include a resinoid flexible grindstone, a flexible grindstone, a resinoid grindstone, and a sanding disc. In a case where the grinding stone is employed as the tip tool P, surface grinding, curved surface grinding, and the like to metal, synthetic resin, marble, concrete, and other workpieces can be performed by suitably selecting kinds of material and abrasive grain of the grinding stone.

Attachment of the tip tool P to the tip tool attachment portion 62 can be performed by bringing the upper surface of the tip tool P into contact with the bottom surface of the washer 621 while inserting the annular tube portion of the washer 621 through the through-hole formed in the center portion in a plan view of the tip tool P, and then threadingly engaging the nut 622 with the male thread portion formed in the lower end portion of the spindle 61. On the other hand, detachment of the tip tool P from the tip tool attachment portion 62 can be performed by releasing the threaded engagement of the nut 622 with the male thread portion of the spindle 61.

The dust proof portion 7 is a dust proof mechanism for suppressing powder dust generated in machining work (such as grinding) using the tip tool P from entering the internal space of the first bearing 51 and the like. The dust proof portion 7 is provided below the first bearing 51 and between the inner surface of the bearing holding portion 232 and the spindle 61. Details of the dust proof portion 7 will be described later.

The wheel guard 8 is provided at the lower end portion of the gear housing 23. The wheel guard 8 is configured to cover the rear portion of the tip tool P in a state where the tip tool P is attached to the tip tool attachment portion 62.

1-2. Operations of Disc Grinder 1

Next, operations of the disc grinder 1 will be described. When a user performs the ON operation to the drive switch 21A of the motor housing 21 in a state where the tip tool P is attached to the tip tool attachment portion 62 and the power supply cord portion 22A is connected to an AC power supply, the switch mechanism 22B comes into the ON state to cause electric power to be supplied from the AC power supply to the motor 3. Upon supply of electric power to the motor 3, the motor 3 is driven and thus the rotation shaft 31 and the pinion gear 41 rotate together about the first rotation axis A1.

By the rotation of the pinion gear 41, rotation of the motor 3 is transmitted to the bevel gear 42 that is in meshing engagement with the pinion gear 41, so that the bevel gear 42, the spindle 61, the tip tool attachment portion 62, and the tip tool P attached to the tip tool attachment portion 62 rotate together about the second rotation axis A2. This rotating tip tool P enables machining work such as grinding.

1-3. Detailed Explanations of Bearing Holding Portion 232, First Bearing 51, Spindle 61, and Dust Proof Portion 7

Next, the bearing holding portion 232, the first bearing 51, the spindle 61, and the dust proof portion 7 will be described in detail with reference to FIGS. 3 through 6.

<1-3-1. Details of Bearing Holding Portion 232>

Figure 4:
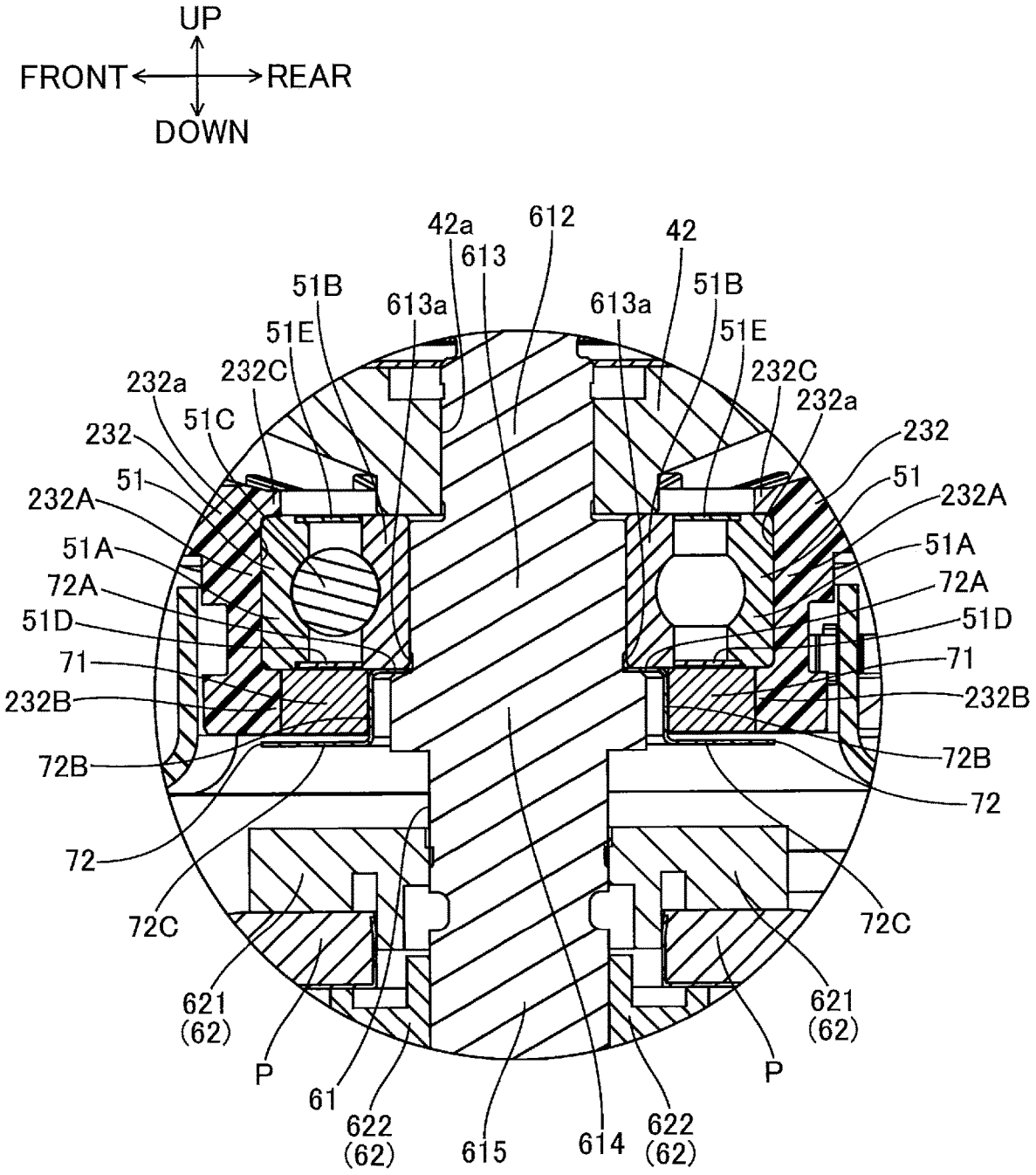
FIG. 4 is an enlarged partial cross-sectional view illustrating a bearing holding portion, a first bearing, an output shaft portion, and a dust proof portion in the disc grinder according to the first embodiment of the present invention.

The bearing holding portion 232 is made of resin. As illustrated in FIG. 4, the bearing holding portion 232 includes a cylindrical supporting portion 232A, a first annular protruding portion 232B, and a second annular protruding portion 232C. Further, the bearing holding portion 232 is formed with an annular recessed portion 232*a*.

The cylindrical supporting portion 232A has a generally hollow cylindrical shape extending in the up-down direction. The cylindrical supporting portion 232A is positioned outward of the first bearing 51 in the radial direction of the spindle 61. The inner circumferential surface of the cylindrical supporting portion 232A is in contact with the outer circumferential surface of the outer race 51A of the first bearing 51, and thus the cylindrical supporting portion 232A supports the outer circumferential surface of the outer race 51A. The dimension in the up-down direction of the cylindrical supporting portion 232A is greater than the dimension in the up-down direction of the outer race 51A. The upper end of the cylindrical supporting portion 232A is positioned upper than the upper end of the outer race 51A, and the lower end of the cylindrical supporting portion 232A is positioned lower than the lower end of the outer race 51A. Note that, in the following description, the radial direction of the spindle 61 will be simply referred to as the "radial direction".

The first annular protruding portion 232B protrudes inward in the radial direction from the portion of the cylindrical supporting portion 232A which is lower than the outer race 51A. The first annular protruding portion 232B has an annular shape in a bottom view. The upper surface of the first annular protruding portion 232B is in contact with the lower surface of the outer race 51A, and thus the first annular protruding portion 232B supports the lower surface of the outer race 51A. The inward end in the radial direction of the first annular protruding portion 232B is positioned further inward in the radial direction than the outer circumferential surface of the outer race 51A and further outward in the radial direction than the inner circumferential surface of the outer race 51A. The first annular protruding portion 232B is an example of the "protruding portion" in the present invention.

The second annular protruding portion 232C protrudes inward in the radial direction from the portion of the cylindrical supporting portion 232A which is upper than the outer race 51A. The second annular protruding portion 232C has an annular shape in a plan view. The lower surface of the second annular protruding portion 232C is in contact with the upper surface of the outer race 51A, and thus the second annular protruding portion 232C supports the upper surface of the outer race 51A. The inward end in the radial direction of the second annular protruding portion 232C is positioned further inward in the radial direction than the outer circumferential surface of the outer race 51A and further outward in the radial direction than the inner circumferential surface of the outer race 51A.

The annular recessed portion 232*a* is a recessed portion defined by the inner circumferential surface of the cylindrical supporting portion 232A, the upper surface of the first annular protruding portion 232B, and the lower surface of the second annular protruding portion 232C. The annular recessed portion 232*a* has an annular shape in a plan view. The dimension in the up-down direction of the annular recessed portion 232*a* is equal to the dimension in the up-down direction of the outer race 51A.

<1-3-2. Details of First Bearing 51>

As illustrated in FIG. 4, in addition to the above-described outer race 51A and inner race 51B, the first bearing 51 includes a plurality of balls 51C, a first annular sealing member 51D, and a second annular sealing member 51E. The balls 51C are interposed between the outer race 51A and the inner race 51B. The first annular sealing member 51D has an annular shape in a plan view. The first annular sealing member 51D seals the lower end of a hollow cylindrical space defined between the inner circumferential surface of the outer race 51A and the outer circumferential surface of the inner race 51B. The second annular sealing member 51E has an annular shape in a plan view. The second annular sealing member 51E seals the upper end of the hollow cylindrical space. In the following description, the hollow cylindrical space defined between the inner circumferential surface of the outer race 51A and the outer circumferential surface of the inner race 51B will be simply referred to as the "internal space of the first bearing 51".

The first bearing 51 is held by the bearing holding portion 232 in a state where the outer circumferential portion of the outer race 51A is accommodated in the annular recessed portion 232*a* of the bearing holding portion 232. Specifically, the outer race 51A is fixed to (held by) the gear housing 23 by molding the bearing holding portion 232 integrally with the outer race 51A. Further, the upper surface of the inner circumferential portion of the inner race 51B is in contact with the lower surface of the bevel gear 42.

Integral molding of the bearing holding portion 232 with the first bearing 51 will be described with reference to FIGS. 6A through 6F. A predetermined mold M illustrated in FIGS. 6A through 6F is used for molding the bearing holding portion 232 integrally with the first bearing 51. The mold M is constituted by a plurality of mold members including a mold member M1 used for molding the lower end part of the bearing holding portion 232. The mold M can be assembled from the plurality of mold members, and can be disassembled into the plurality of mold members.

Figure 6A:
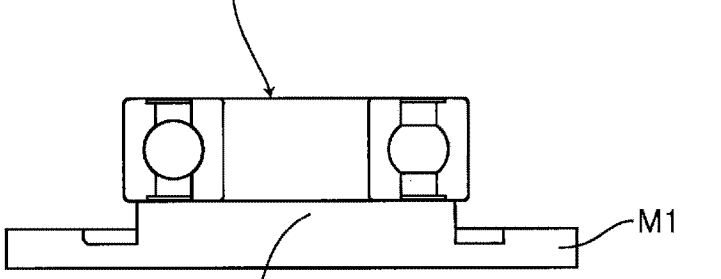

For molding the bearing holding portion 232 integrally with the first bearing 51, firstly, the first bearing 51 is placed on the upper surface of a solid cylindrical portion M2 of the mold member M1 as illustrated in FIG. 6A, and then the first bearing 51 is fixed to the mold member M1 by a prescribed method. Note that the diameter of the solid cylindrical portion M2 is smaller than the diameter of the first bearing 51, and the position in the radial direction of the outer circumferential surface of the solid cylindrical portion M2 is coincident with the position in the radial direction of the inner circumferential surface of the first annular protruding portion 232B.

Figure 6B:
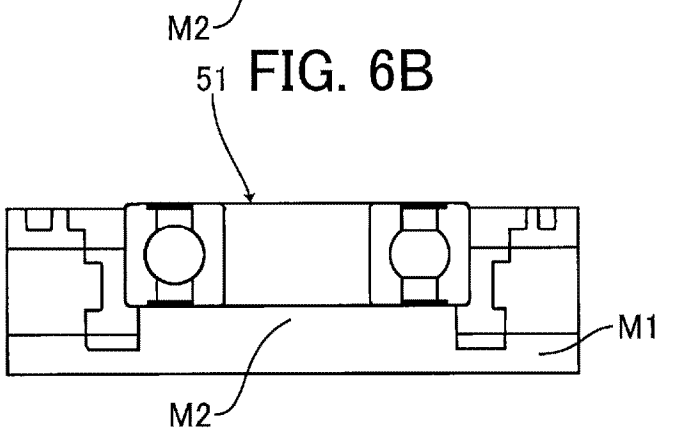
Figure 6C:
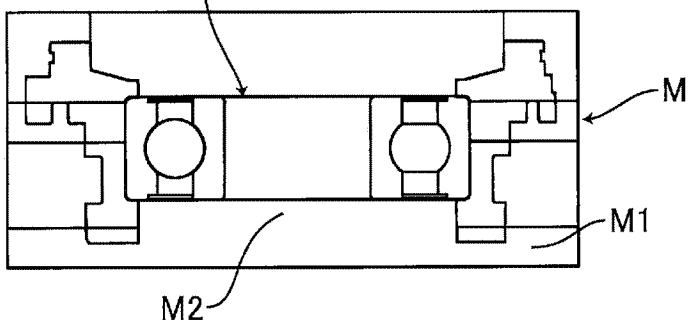
Figure 6D:
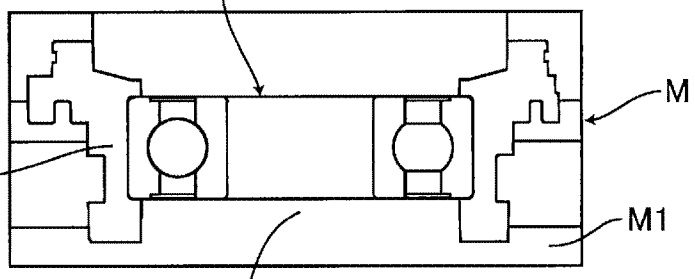
Figure 6E:
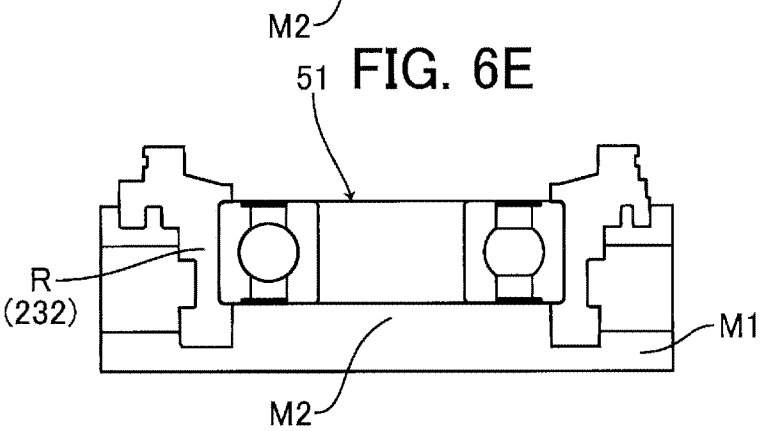
Figure 6F:
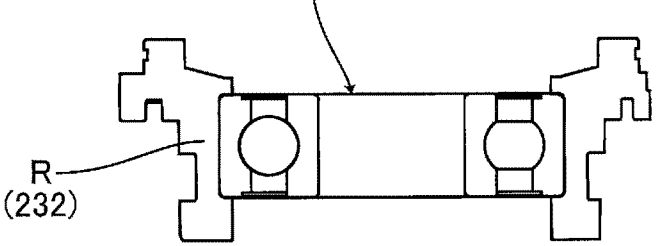

Thereafter, as illustrated in FIGS. 6B and 6C, the remaining mold members used for molding the remaining part of the bearing holding portion 232 which is positioned upper than the lower end part of the bearing holding portion 232 are assembled to the mold member M1 to complete the mold M. In this state, as illustrated in FIG. 6D, liquid resin R heated to a high temperature is poured into the space defined in the mold M through a hole (not illustrated) formed in the mold M. After the resin R is solidified, the mold M is removed from the solidified resin R while being disassembled as illustrated in FIG. 6E. As a result, as illustrated in FIG. 6F, the bearing holding portion 232 having the first bearing 51 held thereon is molded. In this way, the bearing holding portion 232 is molded integrally with the first bearing 51.

<1-3-3. Details of Spindle 61>

As illustrated in FIGS. 3 and 4, the spindle 61 includes a first solid cylindrical portion 611, a second solid cylindrical portion 612, a third solid cylindrical portion 613, a fourth solid cylindrical portion 614, and a fifth solid cylindrical portion 615.

As illustrated in FIG. 3, the first solid cylindrical portion 611 constitutes the upper end portion of the spindle 61, and has a solid cylindrical shape extending in the up-down direction. The first solid cylindrical portion 611 is press-fitted in the second bearing 52.

The second solid cylindrical portion 612 is a solid cylindrical portion continuous with and extending downward from the lower end of the first solid cylindrical portion 611. The second solid cylindrical portion 612 is press-fitted in the through-hole 42*a* of the bevel gear 42. The diameter of the second solid cylindrical portion 612 is greater than the diameter of the first solid cylindrical portion 611.

The third solid cylindrical portion 613 is a solid cylindrical portion continuous with and extending downward from the lower end of the second solid cylindrical portion 612. The third solid cylindrical portion 613 is press-fitted in the inner race 51B of the first bearing 51. The diameter of the third solid cylindrical portion 613 is greater than the diameter of the second solid cylindrical portion 612. The upper end of the third solid cylindrical portion 613 is positioned slightly lower than the upper end of the inner race 51B, and the lower end of the third solid cylindrical portion 613 is positioned slightly lower than the lower end of the inner race 51B.

Further, the entire outer circumferential surface of the lower end portion of the third solid cylindrical portion 613 is slightly recessed inward in the radial direction to form an annular recessed portion 613*a* having an annular shape in a plan view. The upper end of the annular recessed portion 613*a* is positioned upper than the lower end of the inner race 51B, and the lower end of the annular recessed portion 613*a* is positioned lower than the lower end of the inner race 51B. In the present embodiment, the lower end of the annular recessed portion 613*a* is in alignment with the lower end of the third solid cylindrical portion 613.

The fourth solid cylindrical portion 614 is a solid cylindrical portion continuous with and extending downward from the lower end of the third solid cylindrical portion 613. The fourth solid cylindrical portion 614 has a predetermined dimension in the up-down direction. The diameter of the fourth solid cylindrical portion 614 is greater than the diameter of the third solid cylindrical portion 613. The outer circumferential surface of the fourth solid cylindrical portion 614 is positioned further outward in the radial direction than the inner circumferential surface of the inner race 51B and further inward in the radial direction than the outer circumferential surface of the inner race 51B. The upper end of the fourth solid cylindrical portion 614 is positioned slightly lower than the lower end of the inner race 51B, and thus the upper surface of the outer circumferential portion of the fourth solid cylindrical portion 614 is slightly spaced apart from the lower surface of the inner circumferential portion of the inner race 51B.

The fifth solid cylindrical portion 615 constitutes the lower portion of the spindle 61. The fifth solid cylindrical portion 615 is continuous with and extends downward from the lower end of the fourth solid cylindrical portion 614, and protrudes downward from the gear housing 23. Note that the washer 621 of the tip tool attachment portion 62 described above is fixed to the fifth solid cylindrical portion 615.

<1-3-4. Details of Dust Proof Portion 7>

Figure 5:
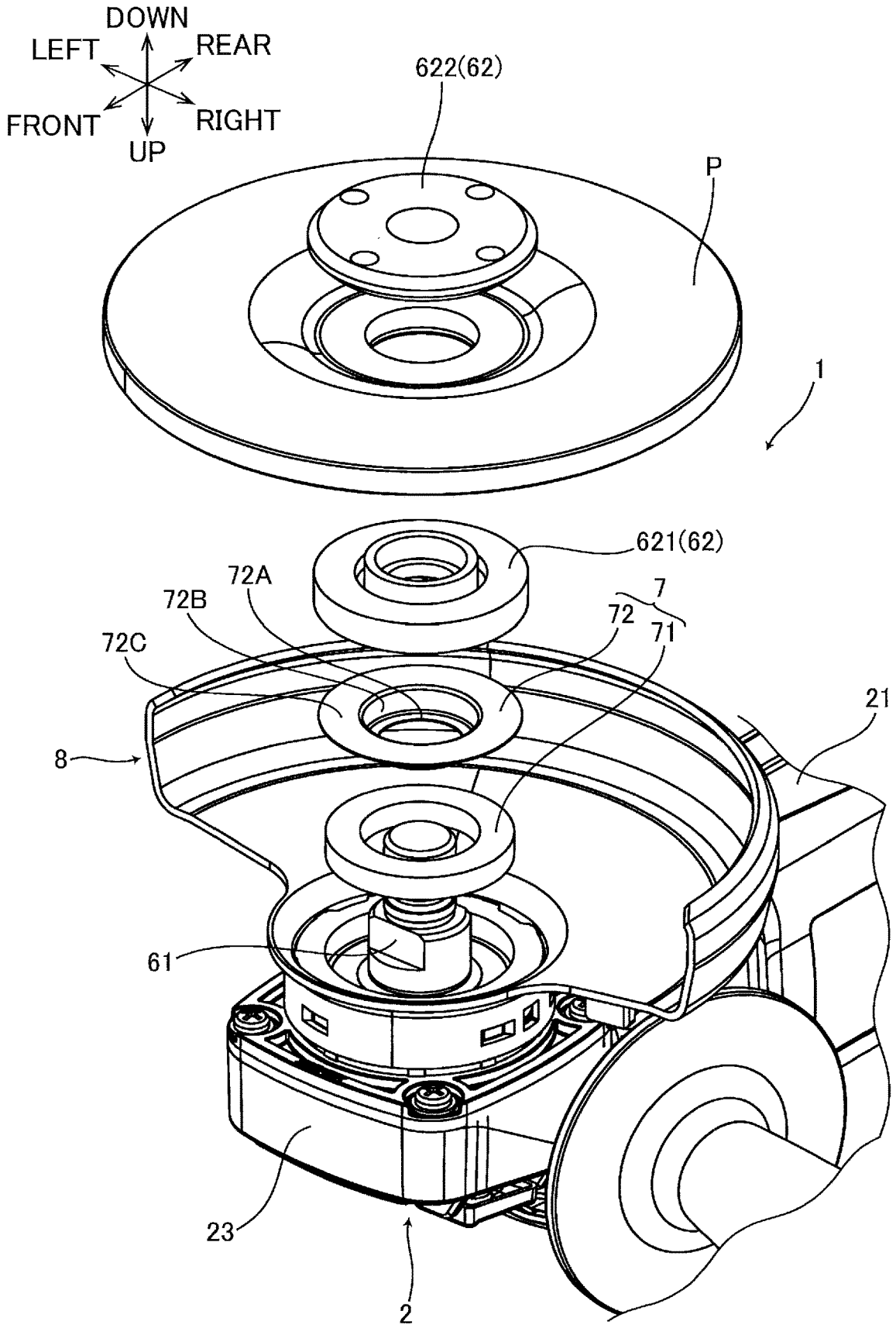
FIG. 5 is an exploded perspective view illustrating the dust proof portion, a tip tool attachment portion, and a tip tool to be attached to the tip tool attachment portion in the disc grinder according to the first embodiment of the present invention.

As illustrated in FIGS. 4 and 5, the dust proof portion 7 includes a dust proof sealing member 71 and a restricting member 72.

The dust proof sealing member 71 is a sealing member for suppressing powder dust generated in machining work such as grinding from entering the internal space (that is, the hollow cylindrical space) of the first bearing 51. The dust proof sealing member 71 is an example of the "sealing member" in the present invention.

The dust proof sealing member 71 has an annular shape in a plan view, and is positioned between the spindle 61 and the first annular protruding portion 232B of the bearing holding portion 232. Specifically, the dust proof sealing member 71 is positioned further inward in the radial direction than the first annular protruding portion 232B and further outward in the radial direction than the spindle 61 (more specifically, the fourth solid cylindrical portion 614) and a cylindrical portion 72B described later. In the present embodiment, a felt impregnated with lubricating oil is employed as the dust proof sealing member 71.

The dimension in the radial direction (the widthwise direction) of the dust proof sealing member 71 is greater than the dimension in the radial direction (the widthwise direction) of the hollow cylindrical space of the first bearing 51. The outer circumferential surface of the dust proof sealing member 71 is positioned further inward in the radial direction than the outer circumferential surface of the outer race 51A and further outward in the radial direction than the inner circumferential surface of the outer race 51A. The inner circumferential surface of the dust proof sealing member 71 is positioned further inward in the radial direction than the outer circumferential surface of the inner race 51B and further outward in the radial direction than the inner circumferential surface of the inner race 51B. That is, at least a part of the dust proof sealing member 71 is overlapped with the inner race 51B in the axial direction. In other words, at least a part of the dust proof sealing member 71 is overlapped with the inner race 51B as viewed in the up-down direction (in the axial direction). More specifically, the inward end portion in the radial direction of the dust proof sealing member 71 is overlapped with the inner race 51B in the axial direction.

Further, the outer circumferential surface of the dust proof sealing member 71 is in contact with the inward end of the first annular protruding portion 232B (that is, the inner circumferential surface of the first annular protruding portion 232B). In other words, the entire hollow cylindrical space of the first bearing 51 is overlapped with the dust proof sealing member 71 in the axial direction. Stated differently, the entirety of the hollow cylindrical space is overlapped with the dust proof sealing member 71 as viewed in the up-down direction.

The dimension in the up-down direction of the dust proof sealing member 71 is equal to the dimension in the up-down direction of the first annular protruding portion 232B. The upper end of the dust proof sealing member 71 is in alignment with the upper end of the first annular protruding portion 232B, and the lower end of the dust proof sealing member 71 is in alignment with the lower end of the first annular protruding portion 232B. Further, the upper surface of the dust proof sealing member 71 is in contact with the lower surface of the inward end portion in the radial direction of the outer race 51A, the lower surface of the first annular sealing member 51D, and the lower surface of the outward end portion in the radial direction of the inner race 51B. That is, the contact portion between the outer race 51A and the first annular sealing member 51D and the contact portion between the inner race 51B and the first annular sealing member 51D, which contact portions could be a pathway of entry of powder dust generated in machining work such as grinding into the internal space of the first bearing 51 (into the hollow cylindrical space), are covered by the dust proof sealing member 71.

The restricting member 72 is made of metal and holds the dust proof sealing member 71 in cooperation with the first annular protruding portion 232B. The restricting member 72 is a member for restricting the dust proof sealing member 71 from moving downward. The restricting member 72 is positioned between the first annular protruding portion 232B and the spindle 61. As illustrated in FIGS. 4 and 5, the restricting member 72 includes an annular portion 72A, the cylindrical portion 72B, and a flange portion 72C The annular portion 72A constitutes the inward portion in the radial direction of the restricting member 72, and has an annular shape in a plan view. The inner circumferential edge portion of the annular portion 72A is nipped and held by the lower surface of the inner race 51B of the first bearing 51 and the upper surface of the fourth solid cylindrical portion 614 of the spindle 61. Hence, the annular portion 72A is fixed to the spindle 61 and the inner race 51B. That is, the restricting member 72 is fixed to the outer circumferential surface of the spindle 61.

The outward end in the radial direction of the annular portion 72A is positioned further inward in the radial direction than the outer circumferential surface of the inner race 51B and further outward in the radial direction than the inner circumferential surface of the inner race 51B. The inward end in the radial direction of the annular portion 72A is positioned further inward in the radial direction than the inner circumferential surface of the inner race 51B and is in contact with the annular recessed portion 613*a* of the third solid cylindrical portion 613. Further, the upper surface of the annular portion 72A is in contact with the lower surface of the inner race 51B.

The cylindrical portion 72B has a hollow cylindrical shape and extends downward from the outer circumferential edge in the radial direction of the annular portion 72A. The cylindrical portion 72B is positioned further inward in the radial direction than the dust proof sealing member 71. The lower end of the cylindrical portion 72B is positioned lower than the lower end of the dust proof sealing member 71. Further, the outer circumferential surface of the cylindrical portion 72B is in contact with the inner circumferential surface of the dust proof sealing member 71, and the cylindrical portion 72B and the first annular protruding portion 232B nip and hold the dust proof sealing member 71 therebetween in cooperation with each other with the dust proof sealing member 71 compressively deformed slightly in the radial direction. The lower end portion of the cylindrical portion 72B is an example of the "end portion in the first direction of the cylindrical portion" in the present invention.

The flange portion 72C extends outward in the radial direction from the outer circumferential surface of the lower end portion of the cylindrical portion 72B, and has an annular shape in a plan view. The flange portion 72C is positioned below the dust proof sealing member 71 with a slight gap formed between the flange portion 72C and the dust proof sealing member 71.

Further, the outward end in the radial direction of the flange portion 72C is positioned further outward in the radial direction than the outer circumferential surface of the dust proof sealing member 71, so that the flange portion 72C covers the lower surface of the dust proof sealing member 71. That is, the entire dust proof sealing member 71 is overlapped with the flange portion 72C in the axial direction. In other words, the entirety of the dust proof sealing member 71 is overlapped with the flange portion 72C as viewed in the up-down direction. With such a structure of the flange portion 72C, if the dust proof sealing member 71 moves downward, the dust proof sealing member 71 comes into contact with the upper surface of the flange portion 72C, so that further downward movement of the dust proof sealing member 71 is restricted. Accordingly, the dust proof sealing member 71 is suppressed from slipping and falling off from the disc grinder 1.

1-4. Functions and Effects of Disc Grinder 1

The disc grinder 1 according to the first embodiment described above includes: the gear housing 23; the spindle 61 extending downward, the lower end portion of the spindle 61 protruding from the gear housing 23, the upper end portion of the spindle 61 being accommodated in the gear housing 23; the first bearing 51 held by the gear housing 23 and including the inner race 51B and the outer race 51A, the first bearing 51 rotatably supporting the spindle 61; the tip tool attachment portion 62 provided at the lower end portion of the spindle 61 and to which the tip tool P is attachable; the dust proof sealing member 71 positioned below the first bearing 51; and the restricting member 72 for restricting the dust proof sealing member 71 from moving downward. Further, the gear housing 23 includes the bearing holding portion 232 molded integrally with the first bearing 51 and holding the first bearing 51. Further, the bearing holding portion 232 includes: the cylindrical supporting portion 232A extending downward and supporting the outer circumferential surface of the outer race 51A; and the first annular protruding portion 232B positioned below the outer race 51A and protruding inward in the radial direction of the spindle 61 from the cylindrical supporting portion 232A to restrict downward movement of the first bearing 51. Further, the inward end in the radial direction of the first annular protruding portion 232B (that is, the inner circumferential surface of the first annular protruding portion 232B) is positioned further inward in the radial direction than the outer circumferential surface of the outer race 51A and further outward in the radial direction than the inner circumferential surface of the outer race 51A. The dust proof sealing member 71 is positioned between the spindle 61 and the first annular protruding portion 232B. At least a part of the dust proof sealing member 71 is overlapped with the inner race 51B in the axial direction, and the restricting member 72 is held by the spindle 61.

In the disc grinder 1 constructed as described above, the restricting member 72 held by the spindle 61 restricts the dust proof sealing member 71 from moving downward at the overlapping position in the axial direction between the dust proof sealing member 71 and the inner race 51B of the first bearing 51. With this arrangement, despite the configuration where the bearing holding portion 232 molded integrally with the first bearing 51 is employed, the position of the dust proof sealing member 71 can be fixed at the overlapping position in the axial direction between the dust proof sealing member 71 and the inner race 51B of the first bearing 51, thereby reducing production cost and attaining favorable sealability. As a result, entry of powder dust generated in machining work into the first bearing 51 can be suitably suppressed, and accordingly, workability can be favorably maintained.

Specifically, effect of reduction in production cost of the disc grinder 1 is obtained when the bearing holding portion 232 molded integrally with the first bearing 51 is employed. However, in a configuration where the bearing holding portion 232 molded integrally with the first bearing 51 is employed like the present embodiment, the inward end in the radial direction of the first annular protruding portion 232B (i.e., the position at which downward movement of the first bearing 51 is restricted) needs to be positioned further outward in the radial direction than the inner circumferential surface of the outer race 51A because the above-described molding process is used for molding the bearing holding portion 232 integrally with the first bearing 51. If the first annular protruding portion 232B were designed to protrude such that its inward end in the radial direction (i.e., the position at which downward movement of the first bearing 51 is restricted) is positioned further inward in the radial direction than the inner circumferential surface of the outer race 51A, the solid cylindrical portion M2 of the mold member M1 would have to be designed to such a small size that the outer circumferential surface of the solid cylindrical portion M2 is positioned further inward in the radial direction than the inner circumferential surface of the outer race 51A, use of the mold member M1 including the solid cylindrical portion M2 designed to have such a small size would cause liquid resin R heated to a high temperature to melt the first annular sealing member 51D of the first bearing 51 and then to enter the internal space of the first bearing 51, and after solidification of the entered resin R, relative rotation between the outer race 51A and the inner race 51B would become impossible.

Further, although the dust proof sealing member 71 exhibits proper sealability at a position overlapping with the inner race 51B in the axial direction, it is difficult to fix the position of the dust proof sealing member 71 at the above-described suitable position in a configuration where the inward end in the radial direction of the first annular protruding portion 232B needs to be positioned further outward in the radial direction than the inner circumferential surface of the outer race 51A.

However, according to the present embodiment, the position of the dust proof sealing member 71 can be fixed at the overlapping position with the inner race 51B of the first bearing 51 in the axial direction by virtue of the restricting member 72 held by the spindle 61 despite the configuration where the bearing holding portion 232 molded integrally with the first bearing 51 is employed, and hence, reduction in production cost and suitable sealability can be realized.

Further, the restricting member 72 of the disc grinder 1 is positioned between the spindle 61 and the first annular protruding portion 232B in the radial direction. That is, the restricting member 72 is positioned in the space between the spindle 61 and the first annular protruding portion 232B which needs to be sealed. Hence, the restricting member 72 also functions as a dust proof member (sealing member). Accordingly, entry of powder dust generated in machining work such as grinding into the first bearing 51 can be further suitably suppressed, and workability can be further favorably maintained.

Further, in the disc grinder 1, the restricting member 72 which is fixed to the spindle 61 rotates together with the spindle 61 when the spindle 61 rotates. Hence, frictional heat is generated between the outer circumferential surface of the cylindrical portion 72B and the inner circumferential surface of the dust proof sealing member 71 by rotation of the spindle 61. However, since in the disc grinder 1 the inner circumferential surface of the dust proof sealing member 71 is positioned further inward in the radial direction than the outer circumferential surface of the inner race 51B, the relative circumferential velocity between the inner circumferential surface of the dust proof sealing member 71 and the outer circumferential surface of the cylindrical portion 72B can be made low in comparison with a structure where the inner circumferential surface of the dust proof sealing member 71 is positioned further outward in the radial direction than the outer circumferential surface of the inner race 51B, and accordingly, generated frictional heat can be lowered. Accordingly, early wearing and degradation of the dust proof sealing member 71 due to frictional heat can be suppressed, thereby maintaining suitable sealability for a long duration.

Further, in the disc grinder 1, a slight gap is formed between the flange portion 72C of the restricting member 72 and the dust proof sealing member 71. Therefore, frictional heat can be suppressed from being generated between the flange portion 72C and the dust proof sealing member 71 when the restricting member 72 rotates together with the spindle 61. As a result, early wearing and degradation of the dust proof sealing member 71 due to frictional heat can be further suppressed.

Further, in the disc grinder 1, a pathway of entry of powder dust generated in machining work such as grinding into the first bearing 51 can be elongated because of the above-described slight gap defined between the flange portion 72C and the dust proof sealing member 71. Hence, entry of powder dust into the first bearing 51 can be further suitably suppressed.

2. Description of Disc Grinder 101 According to Second Embodiment

A disc grinder 101 as an example of a work machine according to a second embodiment of the present invention will be described with reference to FIGS. 7 through 9. The disc grinder 101 has the same basic structure as the disc grinder 1 according to the first embodiment, and therefore, different structures from the first embodiment will be mainly described. Further, the same members, portions, and components in the disc grinder 101 as those in the disc grinder 1 will be designated by the same reference numerals to avoid duplicating description.

The disc grinder 101 is different from the disc grinder 1 in that the disc grinder 101 includes a dust proof portion 170 instead of the dust proof portion 7.

2-1. Details of Dust Proof Portion 170

Figure 7:
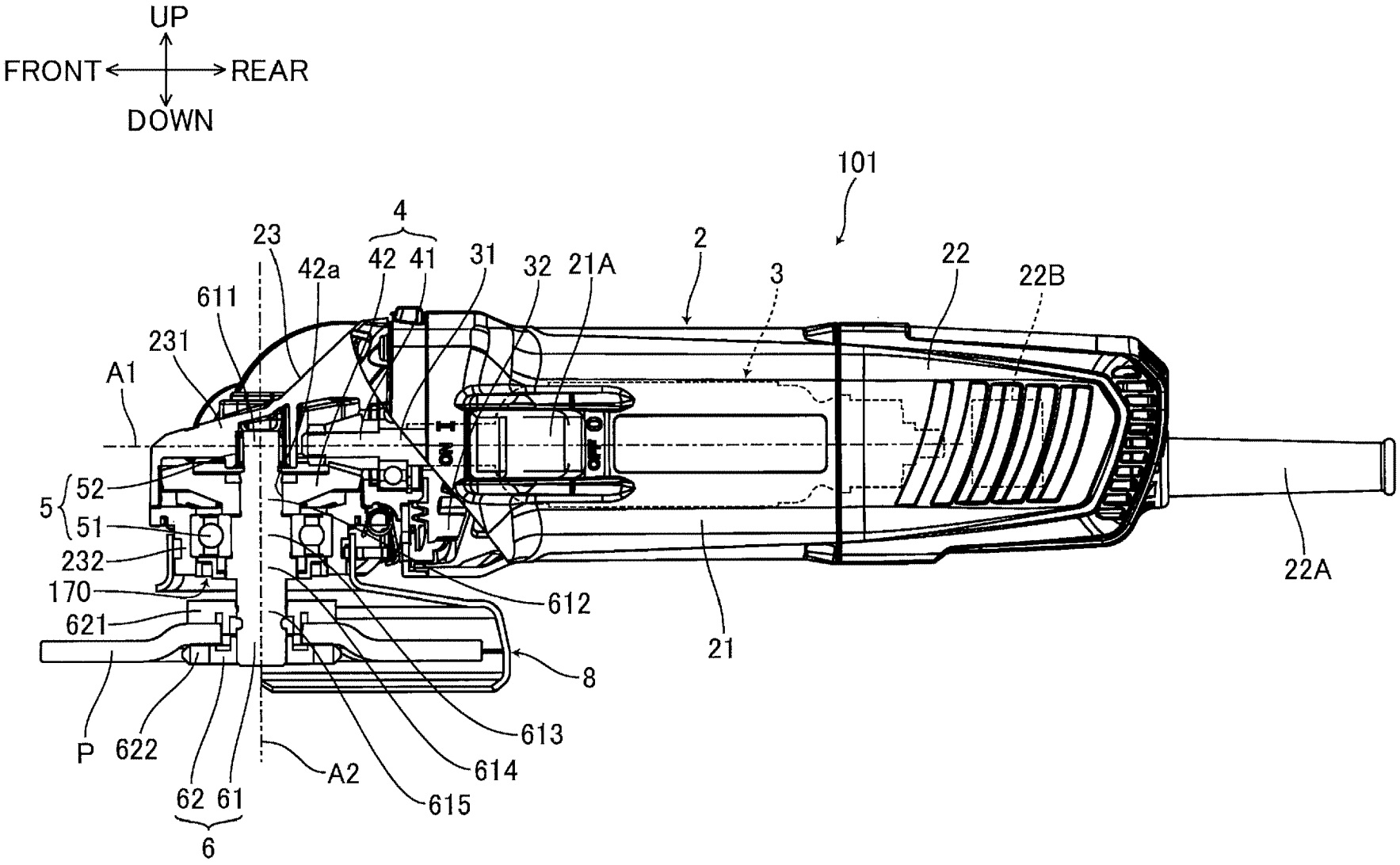
FIG. 7 is a partial vertical cross-sectional view illustrating the internal structure of a disc grinder according to a second embodiment of the present invention.
Figure 8:
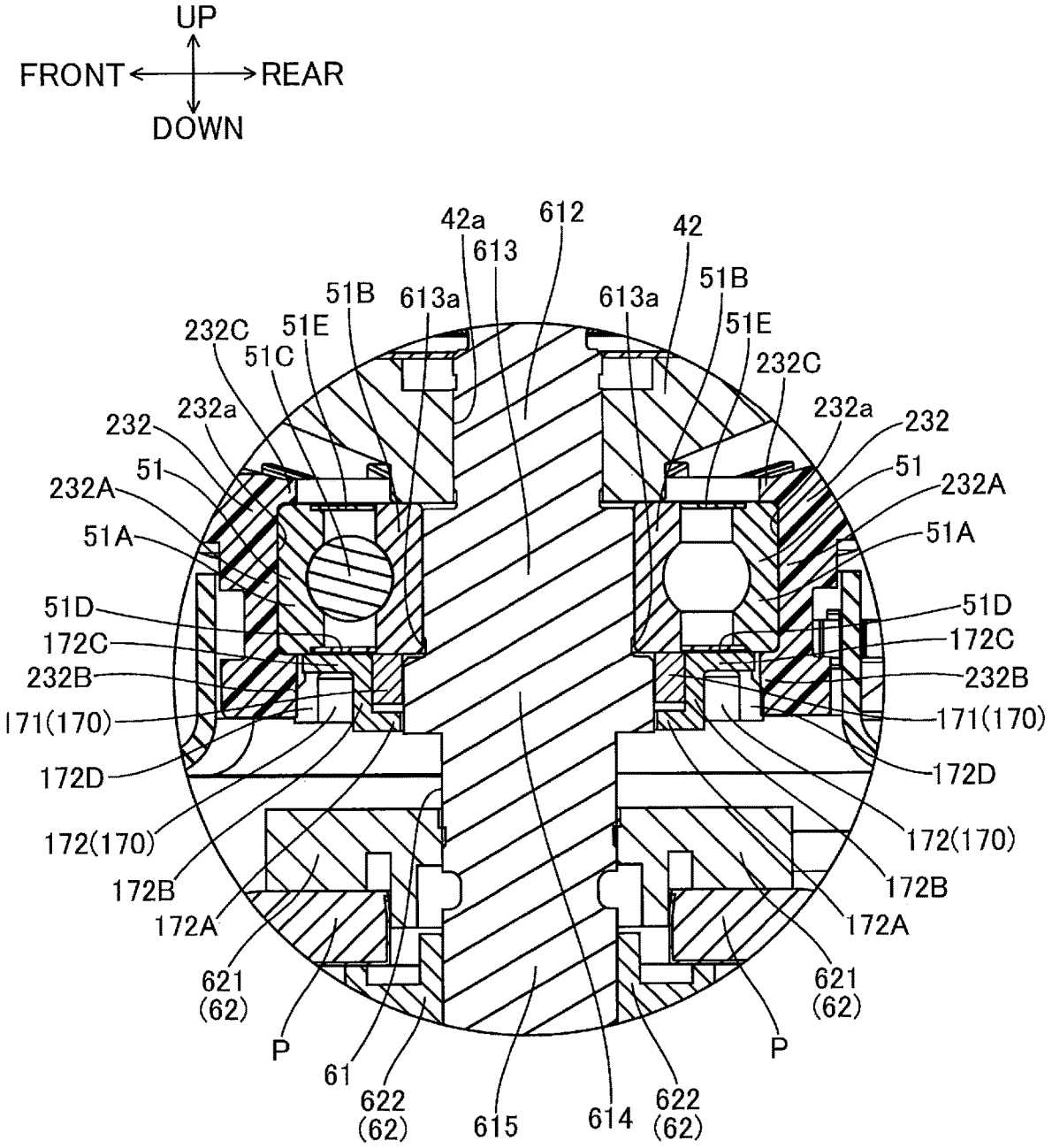
FIG. 8 is an enlarged partial cross-sectional view illustrating a bearing holding portion, a first bearing, an output shaft portion, and a dust proof portion in the disc grinder according to the second embodiment of the present invention.

As illustrated in FIGS. 7 and 8, the dust proof portion 170 includes a dust proof sealing member 171 and a restricting member 172.

The dust proof sealing member 171 has an annular shape in a plan view, and is positioned between the spindle 61 and the first annular protruding portion 232B of the bearing holding portion 232. Specifically, the dust proof sealing member 171 is positioned inward of the first annular protruding portion 232B in the radial direction and outward of the fourth solid cylindrical portion 614 of the spindle 61 in the radial direction. The dust proof sealing member 171 according to this embodiment is a felt impregnated with lubricating oil, as in the dust proof sealing member 71. The dust proof sealing member 171 is an example of the "sealing member" in the present invention.

The dimension in the radial direction of the dust proof sealing member 171 is smaller than the dimension in the radial direction of the dust proof sealing member 71 of the disc grinder 1. Specifically, the dimension in the radial direction of the dust proof sealing member 171 is smaller than the dimension in the radial direction of the outer race 51A, the dimension in the radial direction of the inner race 51B, and the dimension in the radial direction of the hollow cylindrical space. Further, the dimension in the up-down direction of the dust proof sealing member 171 is smaller than the dimension in the radial direction of the dust proof sealing member 71 of the disc grinder 1.

The outer circumferential surface of the dust proof sealing member 171 is positioned further inward in the radial direction than the inner circumferential surface of the outer race 51A and further outward in the radial direction than the outer circumferential surface of the inner race 51B. The inner circumferential surface of the dust proof sealing member 171 is positioned further inward in the radial direction than the outer circumferential surface of the inner race 51B and further outward in the radial direction than the inner circumferential surface of the inner race 51B. That is, at least a part of the dust proof sealing member 171 is overlapped with the inner race 51B in the axial direction. In other words, at least a part of the dust proof sealing member 171 is overlapped with the inner race 51B as viewed in the up-down direction. More specifically, the portion other than the outward end portion in the radial direction of the dust proof sealing member 171 is overlapped with the inner race 51B in the axial direction. Further, the inner circumferential surface of the dust proof sealing member 171 is in contact with the outer circumferential surface of the fourth solid cylindrical portion 614 of the spindle 61.

The dimension in the up-down direction of the dust proof sealing member 171 is smaller than the dimension in the up-down direction the dust proof sealing member 71, and also is smaller than the dimension in the up-down direction of the first annular protruding portion 232B. The upper end of the dust proof sealing member 171 is in alignment with the upper end of the first annular protruding portion 232B, and the lower end of the dust proof sealing member 171 is positioned upper than the lower end of the first annular protruding portion 232B. Further, the upper surface of the dust proof sealing member 171 is in contact with the inward portion in the radial direction of the first annular sealing member 51D of the first bearing 51 and the lower surface of the outward end portion in the radial direction of the inner race 51B that is continuous with that inward portion of the first annular sealing member 51D. That is, the contact portion between the inner race 51B and the first annular sealing member 51D, which contact portion could be a pathway of entry of powder dust into the internal space (the hollow cylindrical space) of the first bearing 51, is covered by the dust proof sealing member 171.

The restricting member 172 is made of metal and holds the dust proof sealing member 171 in cooperation with the fourth solid cylindrical portion 614 of the spindle 61. The restricting member 172 is a member for restricting downward movement of the dust proof sealing member 171. As illustrated in FIGS. 8 and 9, the restricting member 172 has an annular shape as a whole in a plan view, and is press-fitted in the first annular protruding portion 232B of the bearing holding portion 232. Specifically, the restricting member 172 is fitted in a space that has an annular shape in a plan view and is defined by the inner circumferential surface of the first annular protruding portion 232B of the bearing holding portion 232, the lower surface of the first bearing 51, and the outer circumferential surface of the spindle 61. Hence, the restricting member 172 is positioned between the first annular protruding portion 232B and the spindle 61 and is fixed to (held by) the bearing holding portion 232. The restricting member 172 includes an annular portion 172A, a cylindrical portion 172B, a flange portion 172C, and a plurality of protruding wall portions 172D.

The annular portion 172A constitutes the inward portion in the radial direction of the restricting member 172, and has an annular shape in a plan view. The annular portion 172A is positioned outward of the spindle 61 in the radial direction with a slight gap formed between the inward edge portion of the annular portion 172A and the fourth solid cylindrical portion 614 of the spindle 61.

The outward end in the radial direction of the annular portion 172A is positioned further outward in the radial direction than the outer circumferential surface of the inner race 51B and further inward in the radial direction than the inner circumferential surface of the outer race 51A. The inward end in the radial direction of the annular portion 172A is positioned further outward in the radial direction than the inner circumferential surface of the inner race 51B and further inward in the radial direction than the outer circumferential surface of the inner race 51B. Further, the upper surface of the annular portion 172A faces the lower surface of the dust proof sealing member 171 in the up-down direction, and a slight gap is formed between the upper surface of the annular portion 172A and the lower surface of the dust proof sealing member 171. Hence, if the dust proof sealing member 171 moves downward, the dust proof sealing member 171 comes into contact with the upper surface of the annular portion 172A, so that further downward movement of the dust proof sealing member 171 is restricted. Accordingly, the dust proof sealing member 171 can be suppressed from slipping and falling off from the disc grinder 101.

The cylindrical portion 172B has a hollow cylindrical shape and extends upward from the outer circumferential edge in the radial direction of the annular portion 172A. The cylindrical portion 172B is positioned further outward in the radial direction than the dust proof sealing member 171, and the upper surface of the cylindrical portion 172B is in contact with the lower surface of the first annular sealing member 51D of the first bearing 51. Further, the cylindrical portion 172B is in contact with the outer circumferential surface of the dust proof sealing member 171 to nip and hold the dust proof sealing member 171 in cooperation with the fourth solid cylindrical portion 614 with the dust proof sealing member 171 compressively deformed slightly in the radial direction.

The flange portion 172C extends outward in the radial direction from the outer circumferential surface of the upper end portion of the cylindrical portion 172B, and has an annular shape in a plan view. The flange portion 172C is positioned below the first bearing 51. The upper surface of the flange portion 172C is in contact with the lower surface of the inward portion in the radial direction of the outer race 51A and the lower surface of the first annular sealing member 51D. That is, the contact portion between the outer race 51A and the first annular sealing member 51D, which contact portion could be a pathway of entry of powder dust into the internal space (the hollow cylindrical space) of the first bearing 51, is covered by the flange portion 172C.

Further, the outward end in the radial direction of the flange portion 172C is positioned further outward in the radial direction than the inner circumferential surface of the outer race 51A and further inward in the radial direction than the inner circumferential surface of the first annular protruding portion 232B. A slight gap is formed between the outward end in the radial direction of the flange portion 172C and the inner circumferential surface of the first annular protruding portion 232B.

Figure 9:
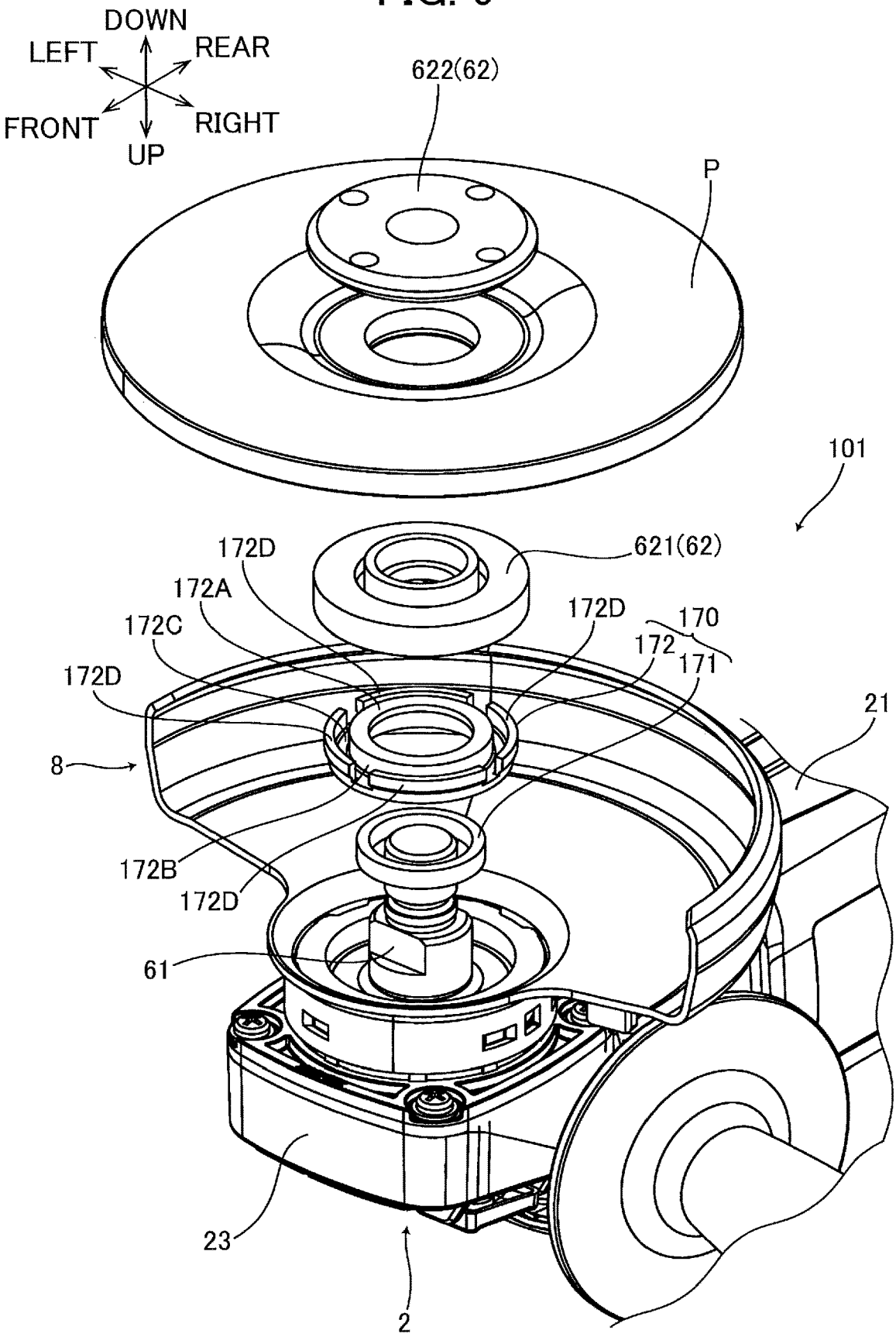
FIG. 9 is an exploded perspective view illustrating the dust proof portion, a tip tool attachment portion, and a tip tool to be attached to the tip tool attachment portion in the disc grinder according to the second embodiment of the present invention.

As illustrated in FIG. 9, each protruding wall portion 172D protrudes downward from the lower surface of the outward circumferential edge portion of the flange portion 172C, and the protruding wall portions 172D have the same shape as each other. The protruding wall portions 172D are arranged at equal intervals in the circumferential direction of the spindle 61 with a predetermined gap formed between every two neighboring protruding wall portions 172D. Further, as illustrated in FIG. 8, the protruding wall portions 172D are bent inward in the radial direction in a state where the restricting member 172 is fitted in the bearing holding portion 232. Accordingly, the outer circumferential surface of each protruding wall portion 172D is in pressure contact with the inner circumferential surface of the first annular protruding portion 232B, whereby the restricting member 172 is fixed to the first annular protruding portion 232B.

2-2. Functions and Effects of Disc Grinder 101

In the above-described disc grinder 101 according to the second embodiment, the restricting member 172 held by the bearing holding portion 232 restricts downward movement of the dust proof sealing member 171 at a position where the dust proof sealing member 171 is overlapped with the inner race 51B of the first bearing 51 in the axial direction. Hence, despite the configuration where the bearing holding portion 232 molded integrally with the first bearing 51 is employed, the position of the dust proof sealing member 171 can be fixed at the overlapping position with the inner race 51B of the first bearing 51 in the axial direction, thereby reducing production cost and providing suitable sealability. Accordingly, entry of powder dust generated by machining work into the first bearing 51 can be suitably suppressed, thereby favorably maintaining workability.

Further, the restricting member 172 of the disc grinder 101 is fixed to the bearing holding portion 232. Therefore, unlike the disc grinder 1 according to the first embodiment, the restricting member 172 is not rotated by rotation of the spindle 61. Hence, friction can be suppressed from being generated between the restricting member 172 and the dust proof sealing member 171 whose position is fixed by the restricting member 172, and accordingly, early wearing and degradation of the dust proof sealing member 171 due to frictional heat can be suppressed.

Further, the dimension in the up-down direction of the dust proof sealing member 171 in the disc grinder 101 is smaller than the dimension in the up-down direction of the dust proof sealing member 71 in the disc grinder 1. Hence, the contact area between the dust proof sealing member 171 and the spindle 61 in the disc grinder 101 is smaller than the contact area between the dust proof sealing member 71 and the cylindrical portion 72B of the restricting member 72 in the disc grinder 1. Therefore, although rotation of the spindle 61 causes frictional heat to be generated between the fourth solid cylindrical portion 614 of the spindle 61 and the dust proof sealing member 171 in the disc grinder 101, the frictional heat generated in the disc grinder 101 can be low in comparison with the frictional heat generated between the dust proof sealing member 71 and the cylindrical portion 72B of the restricting member 72 in the disc grinder 1.

Further, in the disc grinder 101, a slight gap is formed between the dust proof sealing member 171 and the annular portion 172A of the restricting member 172 which restricts downward movement of the dust proof sealing member 171. With this structure, frictional heat can be suppressed from being generated between the dust proof sealing member 171 and the annular portion 172A. Further, the dimension in the radial direction of the dust proof sealing member 171 is smaller than the dimension in the radial direction of the dust proof sealing member 71 of the disc grinder 1. Therefore, even when frictional heat is generated between the dust proof sealing member 171 and the annular portion 172A, the generated frictional heat can be lowered.

Note that the same configurations in the disc grinder 101 as those in the disc grinder 1 exhibit the same functions and effects as those exhibited by the same configurations in the disc grinder 1.

3. Description of Disc Grinder 201 According to Third Embodiment

Next, a disc grinder 201 as an example of a work machine according to a third embodiment of the present invention will be described with reference to FIGS. 10 through 12. The disc grinder 201 has the same basic structure as the disc grinder 1 according to the first embodiment, and therefore, different structures from the first embodiment will be mainly described. Further, the same members, portions, and components in the disc grinder 201 as those in the disc grinder 1 will be designated by the same reference numerals to avoid duplicating description.

The disc grinder 201 is different from the disc grinder 1 in that the disc grinder 201 includes a bearing holding portion 332 and a dust proof portion 270 instead of the bearing holding portion 232 and the dust proof portion 7.

3-1. Details of Bearing Holding Portion 332

Figure 10:
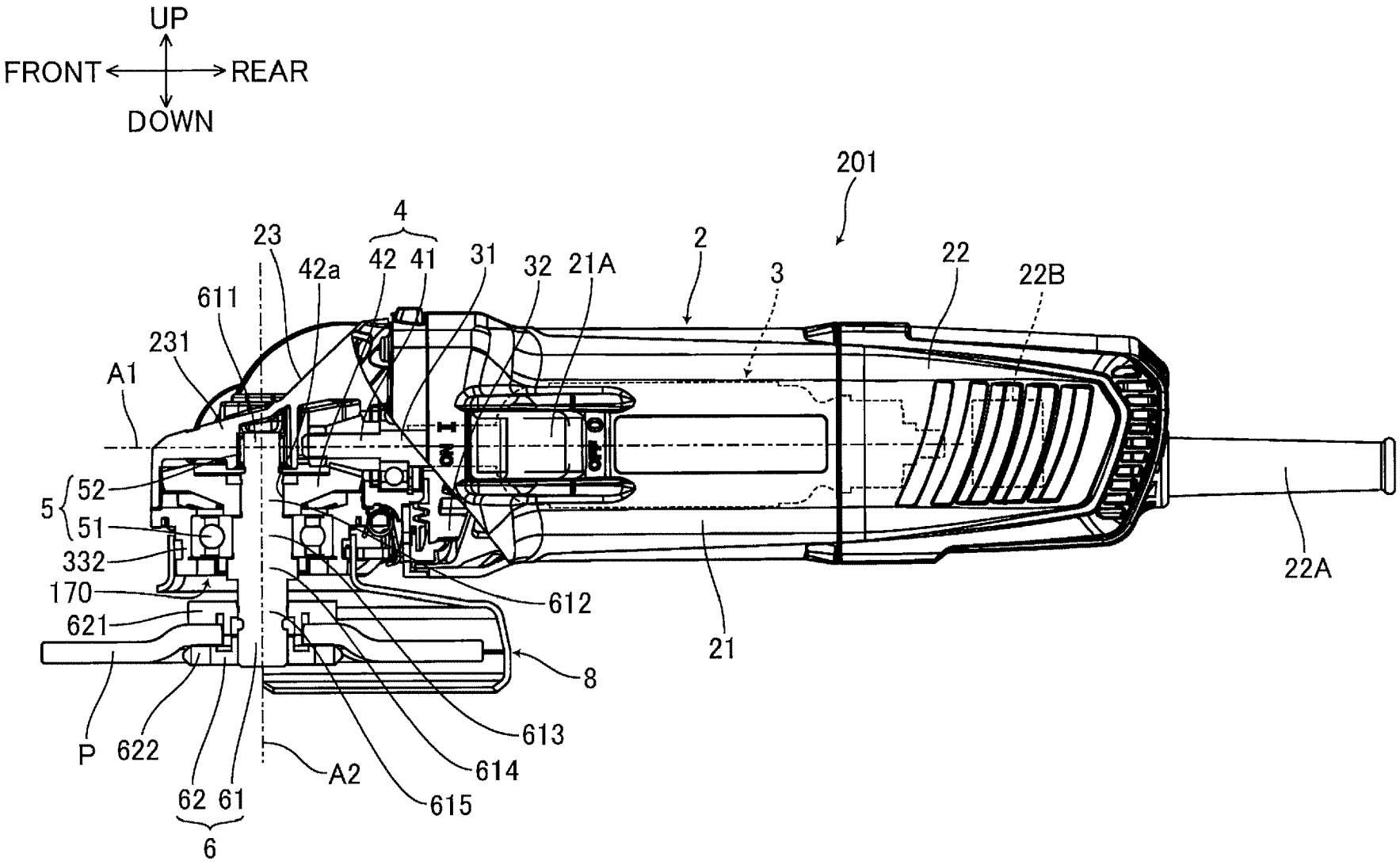
FIG. 10 is a partial vertical cross-sectional view illustrating the internal structure of a disc grinder according to a third embodiment of the present invention.
Figure 11:
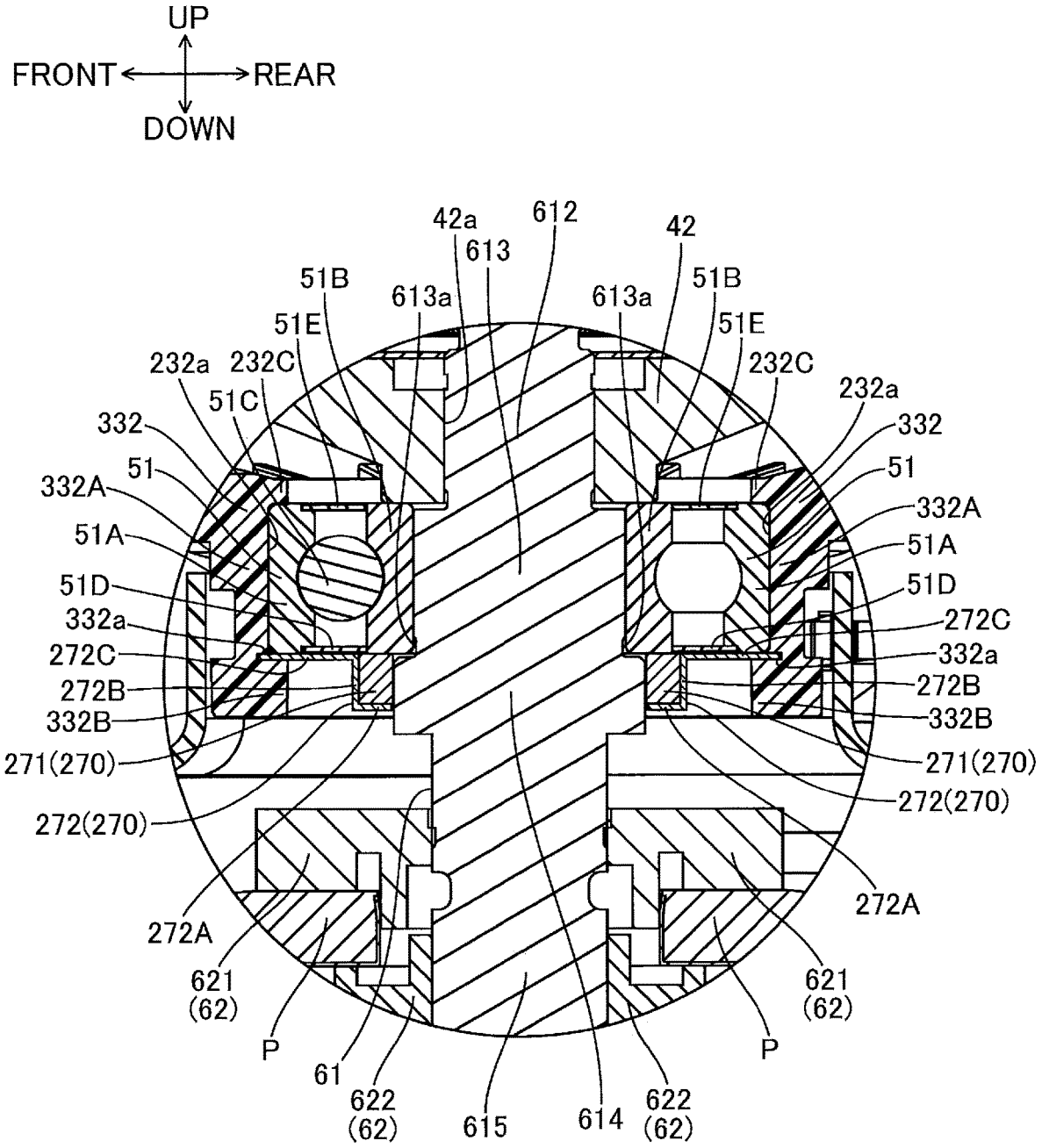
FIG. 11 is an enlarged partial cross-sectional view illustrating a bearing holding portion, a first bearing, an output shaft portion, and a dust proof portion in the disc grinder according to the third embodiment of the present invention.

As illustrated in FIGS. 10 and 11, the bearing holding portion 332 is different from the bearing holding portion 232 of the disc grinder 1 in that the bearing holding portion 332 includes a cylindrical supporting portion 332A and a first annular protruding portion 332B instead of the cylindrical supporting portion 232A and the first annular protruding portion 232B.

The cylindrical supporting portion 332A is different from the cylindrical supporting portion 232A in that the cylindrical supporting portion 332A is formed with an annular recessed portion 332*a*. The annular recessed portion 332*a* is formed in the lower portion of the cylindrical supporting portion 332A. The annular recessed portion 332*a* is recessed outward in the radial direction, and has an annular shape in a plan view. The upper end of the annular recessed portion 332*a* is in alignment with the lower end of the outer race 51A with respect to the up-down direction.

The first annular protruding portion 332B protrudes inward in the radial direction from the portion of the cylindrical supporting portion 332A which is positioned lower than the portion where the annular recessed portion 332*a* is formed. The first annular protruding portion 332B has an annular shape in a bottom view. The inward end in the radial direction of the first annular protruding portion 332B is positioned further inward in the radial direction than the outer circumferential surface of the outer race 51A and further outward in the radial direction than the inner circumferential surface of the outer race 51A. The first annular protruding portion 332B is an example of the "protruding portion" in the present invention.

3-2. Details of Dust Proof Portion 270

As illustrated in FIG. 11, the dust proof portion 270 includes a dust proof sealing member 271 and a restricting member 272.

The dust proof sealing member 271 has an annular shape in a plan view, and is positioned between the first annular protruding portion 332B of the bearing holding portion 332 and the spindle 61. Specifically, the dust proof sealing member 271 is positioned further inward in the radial direction than the first annular protruding portion 332B and further outward in the radial direction than the fourth solid cylindrical portion 614 of the spindle 61. The dust proof sealing member 271 according to this embodiment is a felt impregnated with lubricating oil, as in the dust proof sealing member 71. The dust proof sealing member 271 is an example of the "sealing member" in the present invention.

The dimension in the radial direction of the dust proof sealing member 271 is smaller than the dimension in the radial direction of the dust proof sealing member 71 of the disc grinder 1. Specifically, the dimension in the radial direction of the dust proof sealing member 271 is smaller than the dimension in the radial direction of the outer race 51A, the dimension in the radial direction of the inner race 51B, and the dimension in the radial direction of the hollow cylindrical space.

The outer circumferential surface of the dust proof sealing member 271 is positioned further inward in the radial direction than the inner circumferential surface of the outer race 51A and further outward in the radial direction than the outer circumferential surface of the inner race 51B. The inner circumferential surface of the dust proof sealing member 271 is positioned further inward in the radial direction than the outer circumferential surface of the inner race 51B and further outward in the radial direction than the inner circumferential surface of the inner race 51B. That is, at least a part of the dust proof sealing member 271 is overlapped with the inner race 51B in the axial direction. In other words, at least a part of the dust proof sealing member 271 is overlapped with the inner race 51B as viewed in the up-down direction. More specifically, the portion other than the outward end portion in the radial direction of the dust proof sealing member 271 is overlapped with the inner race 51B in the axial direction. Further, the inner circumferential surface of the dust proof sealing member 271 is in contact with the outer circumferential surface of the fourth solid cylindrical portion 614 of the spindle 61.

The dimension in the up-down direction of the dust proof sealing member 271 is smaller not only than the dimension in the up-down direction of the dust proof sealing member 71 but also than the dimension in the up-down direction of the first annular protruding portion 332B. The upper end of the dust proof sealing member 271 is in alignment with the upper end of the annular recessed portion 332*a* with respect to the up-down direction. The lower end of the dust proof sealing member 271 is positioned upper than the lower end of the first annular protruding portion 332B. Further, the upper surface of the dust proof sealing member 271 is in contact with the lower surface of the inward portion in the radial direction of the first annular sealing member 51D and the lower surface of the outward portion in the radial direction of the inner race 51B. That is, the contact portion between the inner race 51B and the first annular sealing member 51D, which contact portion could be a pathway of entry of powder dust into the internal space of the first bearing 51, is covered by the dust proof sealing member 271.

The restricting member 272 holds the dust proof sealing member 271 in cooperation with the fourth solid cylindrical portion 614 of the spindle 61. The restricting member 272 is a member for restricting the dust proof sealing member 271 from moving downward. The restricting member 272 is made of metal and has an annular shape in a plan view. The restricting member 272 is fixed to the first annular protruding portion 332B of the bearing holding portion 332 as a result of molding the bearing holding portion 332 integrally with both the restricting member 272 and the first bearing 51. The restricting member 272 includes an annular portion 272A, a cylindrical portion 272B, and a flange portion 272C.

Integral molding of the bearing holding portion 332 with both the first bearing 51 and the restricting member 272 will be described with reference to FIGS. 12A through 12F. A predetermined mold N illustrated in FIGS. 12A through 12F is used for molding the bearing holding portion 332 integrally with the first bearing 51 and the restricting member 272. The mold N is constituted by a plurality of mold members including a mold member N1 used for molding the lower end part of the bearing holding portion 332. The mold N can be assembled from the plurality of mold members, and can be disassembled into the plurality of mold members.

Figure 12A:
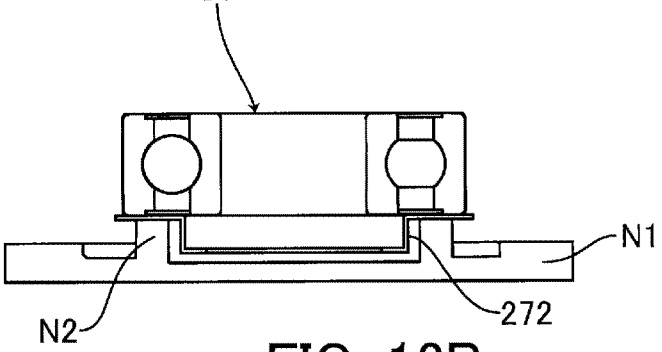

For molding the bearing holding portion 332 integrally with the first bearing 51 and the restricting member 272, firstly, the restricting member 272 is placed on the upper surface of an annular wall portion N2 of the mold member N1, as illustrated in FIG. 12A. Then, the first bearing 51 is placed on the upper surface of the restricting member 272, and then the restricting member 272 and the first bearing 51 are fixed to the mold member N1 by a predetermined method. Note that the diameter of the annular wall portion N2 is smaller than the diameter of the first bearing 51, and the position in the radial direction of the outer circumferential surface of the annular wall portion N2 is coincident with the position in the radial direction of the inner circumferential surface of the first annular protruding portion 332B in the radial direction.

Figure 12B:
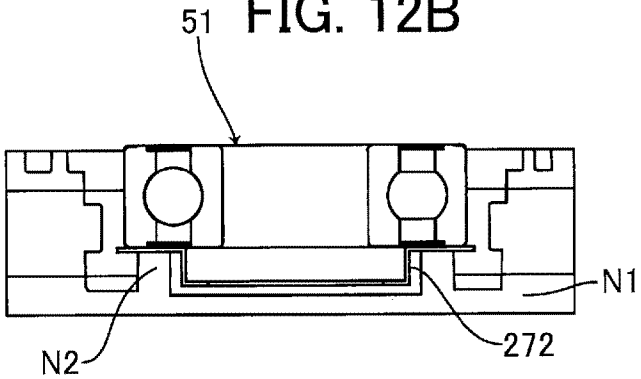
Figure 12C:
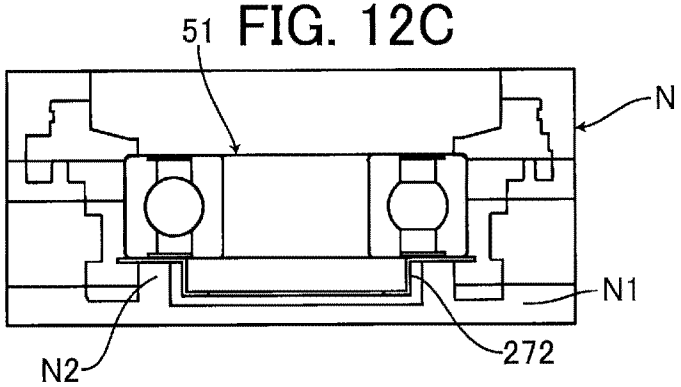
Figure 12D:
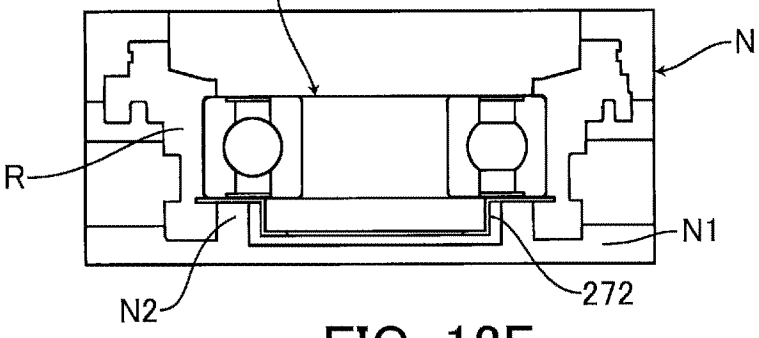
Figure 12E:
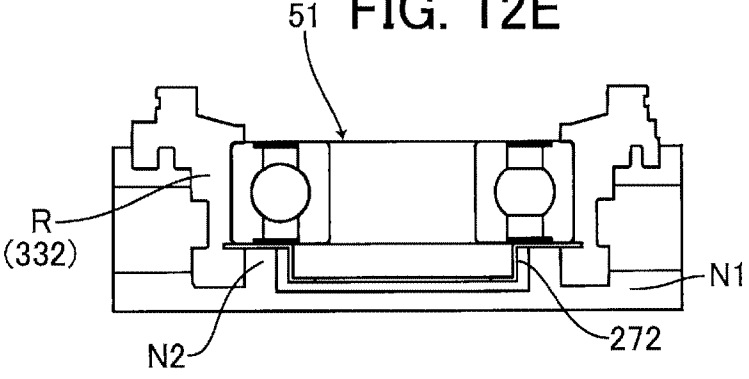
Figure 12F:
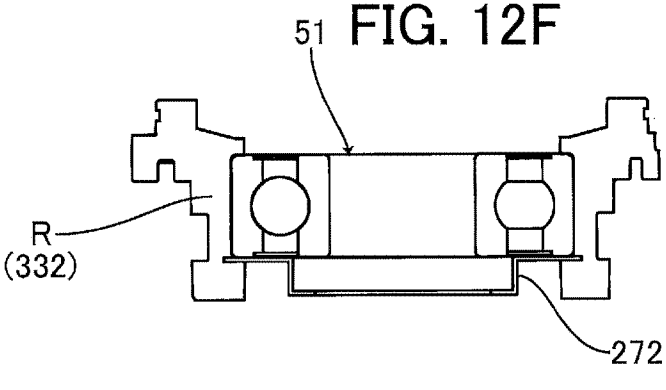

Thereafter, as illustrated in FIGS. 12B and 12C, the remaining mold members used for molding the remaining part of the bearing holding portion 332 which is positioned upper than the lower end part of the bearing holding portion 332 are assembled to the mold member N1 to complete the mold N. In this state, liquid resin R heated to a high temperature is poured into the space defined in the mold N through a hole (not illustrated) formed in the mold N as illustrated in FIG. 12D. After the resin R is solidified, the mold N is removed from the solidified resin R while being disassembled as illustrated in FIG. 12E. As a result, as illustrated in FIG. 12F, the bearing holding portion 332 on which both the restricting member 272 and the first bearing 51 have been held is molded (that is, the bearing holding portion 332 to which both the restricting member 272 and the first bearing 51 have been fixed is molded). In this way, the bearing holding portion 332 is molded integrally with the restricting member 272 and the first bearing 51.

The annular portion 272A constitutes the inward portion in the radial direction of the restricting member 272, and has an annular shape in a plan view. The annular portion 272A is positioned outward of the spindle 61 in the radial direction with a slight gap formed between the inward edge portion of the annular portion 272A and the fourth solid cylindrical portion 614 of the spindle 61.

The outward end in the radial direction of the annular portion 272A is positioned further outward in the radial direction than the outer circumferential surface of the inner race 51B and further inward in the radial direction than the inner circumferential surface of the outer race 51A. The inward end in the radial direction of the annular portion 272A is positioned further outward in the radial direction than the inner circumferential surface of the inner race 51B and further inward in the radial direction than the outer circumferential surface of the inner race 51B.

Further, the upper surface of the annular portion 272A is in contact with the lower surface of the dust proof sealing member 271. Hence, further downward movement of the dust proof sealing member 271 is restricted. Accordingly, the dust proof sealing member 271 is suppressed from slipping and falling off from the disc grinder 201.

The cylindrical portion 272B has a hollow cylindrical shape and extends upward from the outer circumferential edge portion in the radial direction of the annular portion 272A. The cylindrical portion 272B is positioned further outward in the radial direction than the dust proof sealing member 271, and the upper surface of the cylindrical portion 272B is in contact with the lower surface of the first annular sealing member 51D of the first bearing 51. Further, the cylindrical portion 272B is in contact with the outer circumferential surface of the dust proof sealing member 271 to nip and hold the dust proof sealing member 271 in cooperation with the fourth solid cylindrical portion 614 with the dust proof sealing member 271 compressively deformed slightly in the radial direction.

The flange portion 272C extends outward in the radial direction from the outer circumferential surface of the upper end portion of the cylindrical portion 272B, and has an annular shape in a plan view. The extending end portion (i.e., the outward end portion in the radial direction) of the flange portion 272C is fixed to (held by) the cylindrical supporting portion 332A in a state where the extending end portion of the flange portion 272C is accommodated in the annular recessed portion 332*a* formed in the cylindrical supporting portion 332A. Hence, the outward end in the radial direction of the flange portion 272C is positioned further outward in the radial direction than both the outer circumferential surface of the outer race 51A and the inner circumferential surface of the first annular protruding portion 332B. The upper end portion of the cylindrical portion 272B is an example of the "end portion in the second direction of the cylindrical portion" in the present invention.

Further, the flange portion 272C is positioned below the first bearing 51. The upper surface of the flange portion 272C is in contact with the entire lower surface of the outer race 51A and the lower surface of the first annular sealing member 51D which neighbors the lower surface of the outer race 51A. That is, the contact portion between the outer race 51A and the first annular sealing member 51D, which contact portion could be a pathway of entry of powder dust into the internal space of the first bearing 51, is covered by the flange portion 272C. Accordingly, the restricting member 272 functions also as a dust proof member for suppressing powder dust from entering the internal space of the first bearing 51.

3-3. Functions and Effects in Disc Grinder 201

In the disc grinder 201 according to the third embodiment described above, the restricting member 272 held by the bearing holding portion 332 restricts downward movement of the dust proof sealing member 271 at a position where the dust proof sealing member 271 is overlapped with the inner race 51B of the first bearing 51 in the axial direction. Hence, despite the configuration where the bearing holding portion 332 molded integrally with the first bearing 51 is employed, the position of the dust proof sealing member 271 can be fixed at the overlapping position with the inner race 51B of the first bearing 51 in the axial direction, thereby reducing production cost and providing suitable sealability. Accordingly, powder dust generated in machining work can be suitably suppressed from entering the first bearing 51, thereby favorably maintaining workability.

Note that the same configurations in the disc grinder 201 as those in the disc grinder 1 or the disc grinder 101 exhibit the same functions and effects as those exhibited by the same configurations in the disc grinder 1 or the disc grinder 101, as the case may be.

4. Other Modifications

The work machine according to the present invention is not limited to the above-described embodiments, but various modification and improvement may be conceivable within the scope of the claims.

In the descriptions made to the present embodiments, the disc grinders 1, 101, 201 have been exemplified as the work machine. However, the present invention can be applied to work machines other than the disc grinder, such as a circular saw and a drilling tool which are provided with a spindle and a bearing rotatably supporting the spindle.

In the above-described embodiments, the dust proof sealing members 71, 171, and 271 are each a felt impregnated with lubricating oil. However, any member is available as the dust proof sealing members 71, 171, and 271 as long as the member has dust proofing effect. For example, an elastic body such as rubber can be employed as the dust proof sealing members 71, 171, and 271, instead of the felt.

REFERENCE SIGNS LIST

1, 101, 201: disc grinder, 2: housing, 3: motor, 4: power transmission portion, 5: output shaft supporting portion, 6: output shaft portion, 7, 170, 270: dust proof portion; 8: wheel guard, 21: motor housing, 22: tail housing, 23: gear housing, 51: first bearing, 51A: outer race, 51B: inner race, 52: second bearing, 61: spindle, 62: tip tool attachment portion, 71, 171, 271: dust proof sealing member, 72, 172, 272: restricting member, 72A, 172A, 272A: annular portion, 72B, 172B, 272B: cylindrical portion, 72C, 172C, 272C: flange portion, 231: gear cover, 232, 332: bearing holding portion, 232A, 332A: cylindrical supporting portion, 232B, 332B: first annular protruding portion, A1: first rotation axis, A2: second rotation axis, P: tip tool, R: resin

The invention claimed is:

1. A work machine comprising:

a gear housing;

a spindle protruding in a downward direction from the gear housing;

a bearing held by the gear housing and comprising an inner race and an outer race, the bearing rotatably supporting the spindle;

a tip tool attachment portion to which a tip tool is attachable, the tip tool attachment portion being provided at the spindle;

a sealing member positioned below the bearing; and an annular element restricting the sealing member from moving in the downward direction, wherein the gear housing comprises a bearing holding portion holding the bearing, wherein the bearing holding portion comprises:

a cylindrical portion extending in an up-down direction, the cylindrical portion being in contact with an outer circumferential surface of the outer race to support the outer race; and a first protruding portion positioned below the outer race, the first protruding portion protruding inward in a radial direction of the spindle from the cylindrical portion, the first protruding portion being in contact with a lower surface of the outer race from below to restrict the bearing from moving in the downward direction, a second protruding portion positioned above the outer race, the second protruding portion protruding inward in the radial direction of the spindle from the cylindrical portion, the second protruding portion being in contact with an upper surface of the outer race from above to restrict the bearing from moving in an upward direction, wherein the annular element is held either by the spindle or by the gear housing, wherein the cylindrical portion, the first protruding portion and the second protruding portion are included in the gear housing and are formed as a single member, and wherein the first protruding portion is positioned further outward in the radial direction than a lower end of an inner circumferential surface of the outer race, and wherein the second protruding portion is positioned further outward in the radial direction than an upper end of the inner circumferential surface of the outer race.

2. The work machine according to claim 1, wherein an inward end in the radial direction of the first protruding portion is positioned further inward in the radial direction than the outer circumferential surface of the outer race and further outward in the radial direction than the inner circumferential surface of the outer race, and wherein the sealing member is provided between the spindle and the first protruding portion in the radial direction.

3. The work machine according to claim 2, wherein the annular element is fixed to the bearing holding portion.

4. The work machine according to claim 3, wherein the annular element further comprises:

an annular portion positioned outward of the spindle in the radial direction;

the cylindrical portion extending in the up-down direction from an outer circumferential edge in the radial direction of the annular portion; and a flange portion extending outward in the radial direction from an outer circumferential surface of an end portion in the up-down direction of the cylindrical portion, the flange portion being fixed to the bearing holding portion, and wherein the sealing member is positioned between the spindle and the cylindrical portion.

5. The work machine according to claim 3, wherein the annular element is fixed to the bearing holding portion by press-fitting.

6. The work machine according to claim 3, wherein the annular element is fixed to the bearing holding portion by molding the bearing holding portion integrally with the annular element.

7. The work machine according to claim 1, wherein the annular element comprises:

an annular portion extending in the radial direction;

a cylindrical portion extending in the up-down direction to connect the annular portion and a flange portion; and the flange portion extending in the radial direction at a position different from the annular portion in the up-down direction, and wherein the cylindrical portion holds the sealing member, the cylindrical portion being entirely positioned inward than the first protruding portion in the radial direction.

8. A work machine comprising:

a gear housing;

a spindle protruding in a downward direction from the gear housing;

a bearing held by the gear housing and comprising an inner race and an outer race, the bearing rotatably supporting the spindle;

a tip tool attachment portion to which a tip tool is attachable, the tip tool attachment portion being provided at the spindle;

a sealing member positioned below the bearing; and an annular element restricting the sealing member from moving in the downward direction, wherein the gear housing comprises a bearing holding portion holding the bearing, wherein the bearing holding portion comprises:

a cylindrical portion extending in an up-down direction, the cylindrical portion being in contact with an outer circumferential surface of the outer race to support the outer race; and a protruding portion positioned below the outer race, the protruding portion protruding inward in a radial direction of the spindle from the cylindrical portion, the protruding portion being in contact with a lower surface of the outer race from below to restrict the bearing from moving in the downward direction, wherein an inward end in the radial direction of the protruding portion is positioned further inward in the radial direction than the outer circumferential surface of the outer race and further outward in the radial direction than an inner circumferential surface of the outer race, wherein the sealing member is positioned in a space between the spindle and the protruding portion in the radial direction, wherein the annular element is held by the spindle and is configured to rotate together with the spindle, and wherein the annular element restricts a movement of the sealing member in the downward direction by contact with a lower surface of the sealing member.

9. The work machine according to claim 8, wherein the annular element is fixed to an outer circumferential surface of the spindle.

10. The work machine according to claim 9, wherein the annular element further comprises:

an annular portion fixed to the spindle;

a cylindrical portion extending in the downward direction from an outer circumferential edge in the radial direction of the annular portion; and a flange portion extending outward in the radial direction from an outer circumferential surface of an end portion in the downward direction of the cylindrical portion, and wherein the annular element is positioned outward of the cylindrical portion in the radial direction.

11. A work machine comprising:

a gear housing;

a spindle protruding in a downward direction from the gear housing;

a bearing held by the gear housing, the bearing comprising an inner race and an outer race, the bearing rotatably supporting the spindle;

a tip tool attachment portion to which a tip tool is attachable, the tip tool attachment portion being provided at the spindle;

a sealing member positioned below the bearing; and an annular element including:

a first portion extending in a radial direction, the first portion being nipped between the spindle and the inner race in an up-down direction;

a second portion extending downward from an outer circumferential portion in the radial direction of the first portion; and a third portion extending outward in the radial direction from the second portion, the third portion being positioned below the sealing member for restricting the sealing member from moving in the downward direction, wherein the gear housing comprises a bearing holding portion holding the bearing, wherein the bearing holding portion comprises:

a cylindrical portion extending in the up-down direction, the cylindrical portion being in contact with an outer circumferential surface of the outer race to support the outer race; and a protruding portion below the outer race, the protruding portion protruding inward in the radial direction of the spindle from the cylindrical portion, the protruding portion being in contact with a lower surface of the outer race from below to restrict the bearing from moving in the downward direction, wherein the sealing member is positioned between the spindle and the protruding portion in the radial direction, and wherein the annular element is fixed to the spindle by the first portion being nipped between the spindle and the inner race in the up-down direction.

12. The work machine according to claim 11, wherein the third portion is in contact with a lower surface of the sealing member.

13. The work machine according to claim 11, wherein the spindle comprises a large diameter portion, wherein the first portion is nipped between the large diameter portion and the inner race in the up-down direction, and wherein the sealing member is disposed between the protruding portion and the large diameter portion in the radial direction.

14. The work machine according to claim 11, wherein the second portion is positioned apart from both the spindle and the protruding portion in the radial direction, and wherein the sealing member is disposed between the second portion and the protruding portion in the radial direction or between the second portion and the spindle in the radial direction.

* * * * *